US009573383B2

(12) United States Patent
Ukishima

(10) Patent No.: US 9,573,383 B2
(45) Date of Patent: Feb. 21, 2017

(54) TEST IMAGE FORMING SYSTEM AND METHOD, AND ABNORMAL RECORDING ELEMENT DETECTION SYSTEM AND METHOD

(71) Applicant: FUJIFILM Corporation, Tokyo (JP)

(72) Inventor: Masayuki Ukishima, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 14/876,106

(22) Filed: Oct. 6, 2015

(65) Prior Publication Data

US 2016/0101638 A1 Apr. 14, 2016

(30) Foreign Application Priority Data

Oct. 8, 2014 (JP) ..... 2014-207530

(51) Int. Cl.

| | |
|---|---|
| ***B41J 2/21*** | (2006.01) |
| ***B41J 2/045*** | (2006.01) |
| ***B41J 2/165*** | (2006.01) |
| ***B41J 29/393*** | (2006.01) |

(52) U.S. Cl.

CPC ..... *B41J 2/2142* (2013.01); *B41J 2/0451* (2013.01); *B41J 2/04558* (2013.01); *B41J 2/16579* (2013.01); *B41J 2/2132* (2013.01); *B41J 2/2146* (2013.01); *B41J 29/393* (2013.01); *B41J 2029/3935* (2013.01)

(58) Field of Classification Search

CPC ..... B41J 2/2142

See application file for complete search history.

(56) References Cited

U.S. PATENT DOCUMENTS

| | | | | |
|---|---|---|---|---|
| 2005/0018006 | A1* | 1/2005 | Im | B41J 29/393 347/19 |
| 2007/0030300 | A1* | 2/2007 | Jeong | B41J 29/393 347/19 |
| 2010/0053248 | A1* | 3/2010 | Akatsuka | B41J 2/2142 347/14 |
| 2013/0329144 | A1* | 12/2013 | Fukasawa | B41J 2/2142 349/19 |
| 2014/0071191 | A1* | 3/2014 | Ueshima | B41J 2/2146 347/12 |
| 2015/0210068 | A1* | 7/2015 | Mizes | B41J 2/2142 347/14 |

FOREIGN PATENT DOCUMENTS

JP 2005-246650 A 9/2005

* cited by examiner

*Primary Examiner* — Shelby Fidler
(74) *Attorney, Agent, or Firm* — Studebaker & Brackett PC

(57) ABSTRACT

The test image is formed in accordance with input data in which a plurality of recording elements selected every N (an integer of 1 or more) pieces in a projected recording element group is indicated as a first recording element and a recording element that is not selected as the first recording element is indicated as a second recording element, the input data allowing: a first-stage pattern to be formed in a recording area of the second recording element in accordance with a second input gradation value; a recording position in the second direction to be sequentially changed; and the first recording element and the second recording element to be sequentially switched to form a second-stage pattern to an (N+1)-th-stage pattern.

14 Claims, 22 Drawing Sheets

TEST IMAGE FORMING SYSTEM AND METHOD, AND ABNORMAL RECORDING ELEMENT DETECTION SYSTEM AND METHOD

CROSS-REFERENCE TO RELATED APPLICATIONS

The patent application claims priority under 35 U.S.C. §119 to Japanese Patent Application No. 2014-207530 filed on Oct. 8, 2014. Each of the above application(s) is hereby expressly incorporated by reference, in its entirety, into the present application.

BACKGROUND OF THE INVENTION

Field of the Invention

The present invention relates to a test image, a test image forming system, a test image forming method, a test image forming program, an abnormal recording element detection system, an abnormal recording element detection method, an abnormal recording element detection program, and a storage medium, and more particularly, to an abnormality detection technique of a recording element provided in a recording head.

Description of the Related Art

An image recorder of an ink jet method is widely used as an image recorder provided with a plurality of recording elements. An image recorder including an ink jet recording head provided with densely-arranged recording elements is capable of recording a high-definition image.

Abnormality in a recording element provided in a recording head deteriorates image quality. It is possible to prevent image quality from deteriorating by detecting an abnormal recording element to apply correction to a recording position of the abnormal recording element. As detection of an abnormal recording element, there is known a method of creating a test image to detect an abnormal recording element by analyzing the test image.

Japanese Patent Application Laid-Open No. 2005-246650 describes a method of detecting an abnormal recording element by using a test image composed of a ruled line pattern and a solid printing pattern. Finding a white patch in the solid printing pattern detects an abnormal recording element, and observing the ruled line pattern identifies a cause of abnormality of the recording element.

The terms of the recording element and the test image corresponds to terms of a printing element and a test pattern in Japanese Patent Application Laid-Open No. 2005-246650, respectively.

SUMMARY OF THE INVENTION

Unfortunately, even if no abnormality is found in detection of an abnormal recording element by using a test image described in Japanese Patent Application Laid-Open No. 2005-246650, a white streak, which is considered to be caused by an abnormal recording element, may occur in image recording performed after the detection of an abnormal recording element.

The ruled line pattern described in Japanese Patent Application Laid-Open No. 2005-246650 allows a position of an abnormal recording element to be easily identified, however, as locally viewed, the ruled line pattern described in Japanese Patent Application Laid-Open No. 2005-246650 is a specific pattern in which there is no recording of a periphery of a recording position of a recording element of interest. As a result, there is a large difference in recording conditions as compared with image data for allowing an image recorder to record a practical image.

If recording characteristics of each of recording elements do not depend on recording conditions of a peripheral recording element, or if each of the recording elements has highly independent recording characteristics, the ruled line pattern described in Japanese Patent Application Laid-Open No. 2005-246650 favorably works. However, there is a problem in which if the premise that recording characteristics of each of recording elements depend on no recording conditions of a peripheral recording element does not hold, normal recording is performed in the ruled line pattern described in Japanese Patent Application Laid-Open No. 2005-246650 even in a recording element that is likely to become an abnormal recording element in recording of a practical image. The problem has not been paid attention to, and inventors of the present invention have newly found it.

The present invention is made in light of the above-mentioned circumstances, and it is an object of the present invention to provide a test image, a test image forming system, a test image forming method, a test image forming program, a storage medium, an abnormal recording element detection system, an abnormal recording element detection method, an abnormal recording element detection program, and a storage medium, being capable of reliably detecting an abnormal recording element that may be a problem in image recording in detection of an abnormal recording element by using a test image.

In order to achieve the object, a first aspect provides a test image that is formed on a recording medium by relatively moving a recording head and the recording medium in a first direction and a second direction orthogonal to the first direction, and the test image is formed in accordance with input data in which, N representing an integer of 1 or more, a plurality of recording elements selected every N pieces in a projected recording element group of a plurality of recording elements provided in the recording head, projected in the first direction, is indicated as a first recording element and a recording element that is not selected as the first recording element is indicated as a second recording element, and the input data allows a first-stage pattern with a predetermined length to be formed in a recording area of the second recording element in accordance with a second input gradation value in the second direction, and allows a recording position in the second direction to be sequentially changed as well as the first recording element and the second recording element to be sequentially switched to form a second-stage pattern to an (N+1)-th-stage pattern.

The first aspect enables abnormal recording element detection by using a test image that realizes a case where recording characteristics of the first recording element depend on recording conditions of the second recording element arranged in a periphery of the first recording element, and where the first recording element has relatively low independent recording characteristics. Performing the abnormal recording element detection using the test image in accordance with the first aspect enables an abnormal recording element, which may be problem in recording of a practical image, to be reliably detected.

A second aspect provides a test image forming system that forms a test image on a recording medium by relatively moving a recording head and the recording medium in a first direction and a second direction orthogonal to the first direction, and the test image forming system includes: an input data acquiring unit that acquires input data in which, N representing an integer of 1 or more, a plurality of recording elements selected every N pieces in a projected recording element group of a plurality of recording elements provided in the recording head, projected in the first direction, is indicated as a first recording element and a recording element that is not selected as the first recording element is indicated as a second recording element, and the input data allows a first-stage pattern with a predetermined length to be formed in a recording area of the second recording element in accordance with a second input gradation value in the second direction, and allows a recording position in the second direction to be sequentially changed as well as the first recording element and the second recording element to be sequentially switched to form a second-stage pattern to an (N+1)-th-stage pattern; and a test image forming unit that forms the test image in accordance with the input data acquired.

The second aspect is able to form a test image that realizes a case where recording characteristics of the first recording element depend on recording conditions of the second recording element arranged in a periphery of the first recording element, and where the first recording element has relatively low independent recording characteristics.

Performing the abnormal recording element detection using a test image to which recording conditions of a practical image is reflected enables an abnormal recording element, which may be problem in recording of a practical image, to be reliably detected.

In the second aspect, it is preferable to include a halftone processing unit that applies halftone processing to the input data acquired. It is further preferable to include a correction processing unit that applies correction processing to input data, and it is preferable that the halftone processing unit applies the halftone processing to the input data to which the correction processing has been applied.

In a third aspect, the input data acquiring unit of the test image forming system described in the second aspect acquires input data that allows a ruled line portion in accordance with a first input gradation value less than the second input gradation value to be formed at a recording position of the first recording element.

The third aspect allows the ruled line portion in accordance with the first input gradation value to be formed at the recording position of the first recording element to enable recording conditions closer to recording of a practical image to be realized in forming of a test image.

In a fourth aspect, the input data acquiring unit of the test image forming system described in the third aspect acquires input data in which the first input gradation value corresponds to an input gradation value of non-recording.

The fourth aspect allows the recording position of the first recording element to be set as a ruled line portion of non-recording as well as allows a portion between-ruled-lines with a second density value corresponding to the second input gradation value to be recorded in the recording area of the second recording element to enable a difference in density between the ruled line portion and the portion between-ruled-lines to be increased, thereby enabling the ruled line portion and the portion between-ruled-lines to be reliably distinguished.

In a fifth aspect, the input data acquiring unit of the test image forming system described in any one of the second to fourth aspects acquires input data in a case where an ink-jet recording head is used to form a test image, the input data enabling the number N of intervals of a plurality of first recording elements to be determined depending on a state of interference of deposits formed by the ink-jet recording head.

The fifth aspect prevents reduction in width of a ruled line portion and elimination of the ruled line portion caused by merging of ink in opposite portions across the ruled line portion, in a case where an ink-jet recording head is used to form a test image.

In a sixth aspect, the input data acquiring unit of the test image forming system described in any one of the second to fifth aspects acquires input data in a case where an ink-jet recording head is used to form a test image, the input data including at least an input gradation value at a recording position of the second recording element adjacent to a recording position of the first recording element, the input gradation value being reduced with respect to a standard input gradation value at a recording position of the second recording element.

The sixth aspect enables an amount of ink at a recording position of the second recording element adjacent to a recording position of the first recording element to be reduced with respect to a standard amount of ink at a recording position of the second recording element to reduce interference of deposits of ink at opposite recording positions of the second recording element across the recording position of the first recording element, whereby it is possible to prevent reduction in width of a ruled line portion formed at the recording position of the first recording element and elimination of the ruled line portion.

In a seventh aspect, the input data acquiring unit of the test image forming system described in any one of the second to fifth aspects acquires input data in a case where an ink-jet recording head is used to form a test image, the input data including input gradation values of a plurality of recording positions of the respective second recording elements adjacent to a recording position of the first recording element, the input gradation values being reduced with respect to the standard input gradation value at a recording position of the second recording element.

The seventh aspect reduces interference of deposits at opposite recording positions of the respective second recording elements across a recording position of the first recording element, as well as reduces a mutual interference of deposits at recording positions of the respective second recording elements, adjacent to the recording position of the first recording element.

In an eighth aspect, the test image forming system described in any one of the second to fourth aspects includes an amount-of-ink adjusting processing unit in a case where an ink-jet recording head is used to form a test image, the amount-of-ink adjusting processing unit reducing at least an amount of ink at a recording position of the second recording element, adjacent to a recording position of the first recording element, with respect to a standard amount of ink.

The eighth aspect prevents reduction in width of a ruled line portion and elimination of the ruled line portion caused by merging of ink in opposite portions across the ruled line portion.

In a ninth aspect, the test image forming system described in any one of the second to fourth aspects includes an amount-of-ink adjusting processing unit in a case where an ink-jet recording head is used to form a test image, the amount-of-ink adjusting processing unit reducing an amount of ink at recording positions of the respective second recording elements from the second recording element adjacent to a recording position of the first recording element, with respect to a standard amount of ink.

The ninth aspect reduces interference of deposits at opposite recording positions of the respective second recording elements across a recording position of the first recording element, as well as reduces a mutual interference of deposits at recording positions of the respective second recording elements, adjacent to the recording position of the first recording element.

A tenth aspect provides a test image forming method of forming a test image on a recording medium by relatively moving a recording head and the recording medium in a first direction and a second direction orthogonal to the first direction, and the test image forming method includes the steps of: acquiring input data in which, N representing an integer of 1 or more, a plurality of recording elements selected every N pieces in a projected recording element group of a plurality of recording elements provided in the recording head, projected in the first direction, is indicated as a first recording element and a recording element that is not selected as the first recording element is indicated as a second recording element, and the input data allows a first-stage pattern with a predetermined length to be formed in a recording area of the second recording element in accordance with a second input gradation value in the second direction, and allows a recording position in the second direction to be sequentially changed as well as the first recording element and the second recording element to be sequentially switched to form a second-stage pattern to an (N+1)-th-stage pattern; and forming the test image in accordance with the input data acquired.

In the tenth aspect, it is preferable to include a step of applying halftone processing to the input data acquired. It is further preferable to include a step of applying correction processing to the input data, and it is preferable that the halftone processing is applied to the input data to which the correction processing has been applied.

In the tenth aspect, it is preferable that, in the step of acquiring input data, there is acquired input data allowing a ruled line portion based on the first input gradation value less than the second input gradation value to be formed at a recording position of the first recording element.

In the tenth aspect, it is preferable that, in the step of acquiring input data, there is acquired input data in which the first input gradation value corresponds to non-recording.

In the tenth aspect, it is preferable that, in the step of acquiring input data, there is acquired input data in a case where an ink-jet recording head is used to form a test image, the input data enabling the number N of intervals of a plurality of first recording elements to be determined depending on a state of interference of deposits formed by the ink jet recording head.

In the tenth aspect, it is preferable that, in the step of acquiring input data, there is acquired input data in a case where an ink-jet recording head is used to form a test image, the input data including at least an input gradation value at a recording position of the second recording element adjacent to a recording position of the first recording element, the input gradation value being reduced with respect to the standard input gradation value at a recording position of the second recording element.

In the tenth aspect, it is preferable that, in the step of forming the test image in a case where an ink jet recording head is used to form a test image, an amount of ink at a plurality of recording positions of the respective second recording elements, adjacent to a recording position of the first recording element, is reduced with respect to a standard amount of ink.

In the tenth aspect, it is preferable that, in a case where an ink jet recording head is used to form a test image, there is provided a step of processing adjustment of an amount of ink in which at least an amount of ink at a recording position of the second recording element, adjacent to a recording position of the first recording element, is reduced with respect to the standard amount of ink.

In the tenth aspect, it is preferable that, in a case where an ink jet recording head is used to form a test image, there is provided the step of processing adjustment of an amount of ink in which an amount of ink at recording positions of the respective second recording elements from the second recording element adjacent to a recording position of the first recording element, is reduced with respect to the standard amount of ink.

A eleventh aspect provides a test image forming program that allows a test image to be formed on a recording medium by allowing a recording head and the recording medium to relatively move in a first direction and a second direction orthogonal to the first direction, and the test image forming program allows a computer to serve as: an input data acquiring device that acquires input data in which, N representing an integer of 1 or more, a plurality of recording elements selected every N pieces in a projected recording element group of a plurality of recording elements provided in the recording head, projected in the first direction, is indicated as a first recording element and a recording element that is not selected as the first recording element is indicated as a second recording element, and the input data allows a first-stage pattern with a predetermined length to be formed in a recording area of the second recording element in accordance with a second input gradation value in the second direction, and allows a recording position in the second direction to be sequentially changed as well as the first recording element and the second recording element to be sequentially switched to form a second-stage pattern to an (N+1)-th-stage pattern; and a test image forming device that forms the test image in accordance with the input data acquired.

In the eleventh aspect, it is preferable to allow the computer to serve as a halftone processing device that applies halftone processing to the input data acquired. It is further preferable to allow the computer to serve as a correction processing device that applies correction processing to the input data as well as to allow the computer to serve as the halftone processing device to apply the halftone processing to the input data to which the correction processing has been applied.

In the eleventh aspect, it is preferable to allow the computer to serve as an input data acquiring device that acquires input data allowing a ruled line portion based on the first input gradation value less than the second input gradation value to be formed at a recording position of the first recording element.

In the eleventh aspect, it is preferable to allow the computer to serve as the input data acquiring device that acquires input data in which the first input gradation value corresponds to non-recording.

In the eleventh aspect, it is preferable to allow the computer to serve as the input data acquiring device that acquires input data in a case where an ink-jet recording head is used to form a test image, the input data enabling the number N of intervals of a plurality of first recording elements to be determined depending on a state of interference of deposits formed by the ink-jet recording head.

In the eleventh aspect, it is preferable to allow the computer to serve as the input data acquiring device that acquires input data in a case where an ink-jet recording head is used to form a test image, the input data including at least an input gradation value at a recording position of the second recording element adjacent to a recording position of the first recording element, the input gradation value being reduced with respect to a standard input gradation value at a recording position of the second recording element.

In the eleventh aspect, it is preferable to allow the computer to serve as the input data acquiring device that acquires input data in a case where an ink-jet recording head is used to form a test image, the input data including input gradation values of a plurality of recording positions of the respective second recording elements, adjacent to a recording position of the first recording element, the input gradation values being reduced with respect to the standard input gradation value at a recording position of the second recording element.

In the eleventh aspect, it is preferable to allow the computer to serve as an ink adjusting processing device in a case where an ink jet recording head is used to form a test image, the ink adjusting processing device reducing at least an amount of ink at a recording position of the second recording element, adjacent to a recording position of the first recording element, with respect to the standard amount of ink.

In the eleventh aspect, it is preferable to allow the computer to serve as the ink adjusting processing device in a case where an ink jet recording head is used to form a test image, the ink adjusting processing device reducing an amount of ink at recording positions of the respective second recording elements from the second recording element adjacent to a recording position of the first recording element, is reduced with respect to the standard amount of ink.

A twelfths aspect provides a computer-readable storage medium that stores a test image forming program that controls a test image forming method of forming a test image on a recording medium by relatively moving a recording head and the recording medium to in a first direction and a second direction orthogonal to the first direction, and the test image forming program allows a computer to serve as: an input data acquiring device that acquires input data in which, N representing an integer of 1 or more, a plurality of recording elements selected every N pieces in a projected recording element group of a plurality of recording elements provided in the recording head, projected in the first direction, is indicated as a first recording element and a recording element that is not selected as the first recording element is indicated as a second recording element, and the input data allows a first-stage pattern with a predetermined length to be formed in a recording area of the second recording element in accordance with a second input gradation value in the second direction, and allows a recording position in the second direction to be sequentially changed as well as the first recording element and the second recording element to be sequentially switched to form a second-stage pattern to an (N+1)-th-stage pattern; and a test image forming device that forms the test image in accordance with the input data acquired.

A thirteenth aspect provides a computer-readable storage medium that stores a test image formed on a recording medium by relatively moving a recording head and the recording medium in a first direction and a second direction orthogonal to the first direction, and the test image is formed in accordance with input data in which, N representing an integer of 1 or more, a plurality of recording elements selected every N pieces in a projected recording element group of a plurality of recording elements provided in the recording head, projected in the first direction, is indicated as a first recording element and a recording element that is not selected as the first recording element is indicated as a second recording element, and the input data allows a first-stage pattern with a predetermined length to be formed in a recording area of the second recording element in accordance with a second input gradation value in the second direction, and allows a recording position in the second direction to be sequentially changed as well as the first recording element and the second recording element to be sequentially switched to form a second-stage pattern to an (N+1)-th-stage pattern.

A fourteenth aspect provides an abnormal recording element detection system that includes: a test image acquiring unit that acquires a test image created in accordance with input data or reading data on the test image, the input data allowing the test image to be formed on a recording medium by allowing a recording head and the recording medium to relatively move in a first direction and a second direction orthogonal to the first direction, in which input data, N representing an integer of 1 or more, a plurality of recording elements selected every N pieces in a projected recording element group of a plurality of recording elements provided in the recording head, is indicated as a first recording element projected in the first direction, and a recording element that is not selected as the first recording element is indicated as a second recording element, the input data allowing a first-stage pattern with a predetermined length to be formed in a recording area of the second recording element in accordance with a second input gradation value in the second direction, and a recording position in the second direction to be sequentially changed, as well as the first recording element and the second recording element to be sequentially switched to form a second-stage pattern to an (N+1)-th-stage pattern; and an analysis unit that analyzes the test image acquired to detect an abnormal recording element in the recording head.

The fourteenth aspect allows a periphery of a recording position of the first recording element to be set as a recording area of the second recording element to perform recording in the recording area of the second recording element, thereby allowing an abnormal recording element to be detected by using a test image to which recording conditions of the first recording element similar to recording conditions of a practical image is reflected as well as low independent recording conditions of the first recording element, in which the first recording element is affected by peripheral second recording elements, is reflected to enable an abnormal recording element that may cause abnormality to be reliably detected in recording of the practical image.

In a fifteenth aspect, the analysis unit of the abnormal recording element detection system described in the fourteenth aspect extracts a low density position with density less than the second density value corresponding to the second input gradation value from a recording area of the second recording element in the test image to identify a plurality of recording elements expected to include an abnormal recording element in accordance with the low density position extracted.

The fifteenth aspect allows a low density position with density less than the second density value corresponding to the second input gradation value to be extracted from the recording area of the second recording element to enable a plurality of recording elements expected to include an abnormal recording element to be identified from the low density position.

In a sixteenth aspect, the analysis unit of the abnormal recording element detection system described in the fourteenth aspect extracts a high density position with density more than the second density value corresponding to the second input gradation value from a recording area of the second recording element in the test image to detect an abnormal recording element in accordance with the high density position extracted.

The sixteenth aspect allows a high density position with density more than the second density value corresponding to the second input gradation value to be extracted from the recording area of the second recording element to enable a plurality of recording elements that include an abnormal recording element to be identified from the high density position.

In a seventeenth aspect, the analysis unit of the abnormal recording element detection system described in any one of the fourteenth to sixteenth aspects identifies a stage with no abnormal recording as well as identifies a recording element corresponding to a stage identified from among a plurality of recording elements expected to include an abnormal recording element as an abnormal recording element.

The seventeenth aspect allows a stage with no abnormal recording to be identified to enable a recording element corresponding to a stage identified from among a plurality of recording elements expected to include an abnormal recording element to be identified as an abnormal recording element.

In an eighteenth aspect, the analysis unit of the abnormal recording element detection system described in the fifteenth aspect identifies a stage with a uniform interval of the low density position as a stage with no abnormality.

If there is an abnormal recording element in which a position shift in recording occurs, or if there is an abnormal recording element with insufficient recording density, the eighteenth aspect enables the abnormal recording element to be identified.

In a nineteenth aspect, the analysis unit of the abnormal recording element detection system described in the sixteenth aspect identifies a stage with a lack of a high density position as well as with a uniform interval of the low density position with density less than the second density value corresponding to the second input gradation value, as a stage with no abnormality.

If there is an abnormal recording element with excessive recording density, the nineteenth aspect enables an abnormal recording element to be identified.

In a twentieth aspect, the analysis unit of the abnormal recording element detection system described in the seventeenth aspect creates a detection profile showing a relationship between a reading position and a reading signal value for each of stages constituting the test image in accordance with the acquired reading data on the test image to identify a stage whose detection profile has no difference from a reference profile, which is previously acquired as a base, as a stage with no abnormality in a detection profile.

The twentieth aspect enables a stage with no abnormality to be identified in accordance with a detection profile and a reference profile.

In a twenty first aspect, the reference profile of the abnormal recording element detection system described in the twentieth aspect is created from reading data on a test image recorded by using a recording head with no abnormal recording element.

The twenty first aspect allows a reference profile to which a state of a recording head with no abnormal recording element is reflected to be created.

In a twenty second aspect, the abnormal recording element detection system described in the twentieth aspect creates the reference profile by extracting portions recorded by a normal recording element in the detection profile created from the reading data on the test image to create copies of the respective extracted portions to join the copies of the respective extracted portions.

The twenty second aspect enables a reference profile to be created by using a recording head with an abnormal recording element.

In a twenty third aspect, the abnormal recording element detection system described in any one of the fourteenth to the twenty first aspects allows the test image acquiring unit to acquire a test image including a uniform density portion with a third density value corresponding to a third input gradation value in a recording area of the first recording element and a recording area of the second recording element, and allows the analysis unit to identify a plurality of recording elements expected to include an abnormal recording element in accordance with an analysis result of the uniform density portion.

The twenty third aspect enables a low density position with good robustness to be extracted from a uniform density portion because the uniform density portion includes no portion where density is sharply changed to cause a noise to easily occur.

The first input gradation value is applicable to the third input gradation value. The second input gradation value is also applicable to the third input gradation value. In addition, a gradation value different from the first input gradation value and the second input gradation value is applicable to the third input gradation value.

In a twenty fourth aspect, the abnormal recording element detection system described in any one of the fourteenth to the twenty second aspects allows the test image acquiring unit to acquire a practical image, and allows the analysis unit to identify a plurality of recording elements expected to include an abnormal recording element in accordance with the acquired practical image.

The twenty fourth aspect enables a low density position to be extracted in actual recording conditions.

A twenty fifth aspect provides an abnormal recording element detection method that includes the steps of: acquiring a test image created in accordance with input data or reading data on the test image, the input data allowing the test image to be formed on a recording medium by allowing a recording head and the recording medium to relatively move in a first direction and a second direction orthogonal to the first direction, in which input data, N representing an integer of 1 or more, a plurality of recording elements selected every N pieces in a projected recording element group of a plurality of recording elements provided in the recording head, projected in the first direction, is indicated as a first recording element and a recording element that is not selected as the first recording element is indicated as a second recording element, the input data allowing a first-stage pattern with a predetermined length to be formed in a recording area of the second recording element in accordance with a second input gradation value in the second direction, and a recording position in the second direction to be sequentially changed, as well as the first recording element and the second recording element to be sequentially switched to form a second-stage pattern to an (N+1)-th-stage pattern; and analyzing the test image acquired to detect an abnormal recording element in the recording head.

In the twenty fifth aspect, it is preferable that the step of analyzing allows a low density position with density less than the second density value corresponding to the second input gradation value to be extracted from a recording area of the second recording element in the test image to identify a plurality of recording elements expected to include an abnormal recording element in accordance with the extracted low density position.

In the twenty fifth aspect, it is preferable that the step of analyzing allows a high density position with density more than the second density value corresponding to the second input gradation value to be extracted from a recording area of the second recording element in the test image to detect an abnormal recording element in accordance with the extracted high density position.

In the twenty fifth aspect, it is preferable that the step of analyzing allows a stage with no abnormal recording to be identified and a recording element corresponding to a stage identified from among a plurality of recording elements expected to include an abnormal recording element to be identified as an abnormal recording element.

In the twenty fifth aspect, it is preferable that the step of analyzing allows a stage with a uniform interval of the low density position to be identified as a stage with no abnormality.

In the twenty fifth aspect, it is preferable that the step of analyzing allows a stage with a lack of a high density position as well as with a uniform interval of the low density position with density less than the second density value corresponding to the second input gradation value to be identified as a stage with no abnormality.

In the twenty fifth aspect, it is preferable that the step of analyzing allows a detection profile showing a relationship between a reading position and a reading signal value for each of stages constituting the test image to be created in accordance with the acquired reading data on the test image to identify a stage whose detection profile has no difference from a reference profile, which is previously acquired as a base, as a stage with no abnormality in a detection profile.

In the twenty fifth aspect, it is preferable that the reference profile is created from reading data on a test image recorded by using a recording head with no abnormal recording element.

In the twenty fifth aspect, it is preferable that the reference profile is created by extracting portions recorded by a normal recording element in the detection profile created from the reading data on the test image to create copies of the respective extracted portions to join the copies of the respective extracted portions.

In the twenty fifth aspect, it is preferable that the step of acquiring a test image allows a test image including a uniform density portion with the third density value corresponding to the third input gradation value in a recording area of the first recording element and a recording area of the second recording element to be acquired, and that the step of analyzing allows a plurality of recording elements expected to include an abnormal recording element to be identified in accordance with an analysis result of the uniform density portion.

In the twenty fifth aspect, it is preferable that the step of acquiring a test image allows a practical image to be acquired, and that the step of analyzing allows a plurality of recording elements expected to include an abnormal recording element to be identified in accordance with the acquired practical image.

A twenty sixth aspect provides an abnormal recording element detection program that allows a computer to serve as: a test image acquiring device that acquires a test image created in accordance with input data or reading data on the test image, the input data allowing the test image to be formed on a recording medium by allowing a recording head and the recording medium to relatively move in a first direction and a second direction orthogonal to the first direction, in which input data, N representing an integer of 1 or more, a plurality of recording elements selected every N pieces in a projected recording element group of a plurality of recording elements provided in the recording head, projected in the first direction, is indicated as a first recording element and a recording element that is not selected as the first recording element is indicated as a second recording element, the input data allowing a first-stage pattern with a predetermined length to be formed in a recording area of the second recording element in accordance with a second input gradation value in the second direction, and a recording position in the second direction to be sequentially changed, as well as the first recording element and the second recording element to be sequentially switched to form a second-stage pattern to an (N+1)-th-stage pattern; and an analysis device that analyzes the test image acquired to detect an abnormal recording element in the recording head.

In the twenty sixth aspect, it is preferable to allow the computer to serve as the analysis device to extract a low density position with density less than the second density value corresponding to the second input gradation value from a recording area of the second recording element in the test image to identify a plurality of recording elements expected to include an abnormal recording element in accordance with the extracted low density position.

In the twenty sixth aspect, it is preferable to allow the computer to serve as the analysis device to extract a high density position with density more than the second density value corresponding to the second input gradation value from a recording area of the second recording element in the test image to detect an abnormal recording element in accordance with the extracted high density position.

In the twenty sixth aspect, it is preferable to allow the computer to serve as the analysis device to identify a stage with no abnormal recording and identify a recording element corresponding to a stage identified from among a plurality of recording elements expected to include an abnormal recording element as an abnormal recording element.

In the twenty sixth aspect, it is preferable to allow the computer to serve as the analysis device to identify a stage with a uniform interval of the low density position as a stage with no abnormality.

In the twenty sixth aspect, it is preferable to allow the computer to serve as the analysis device to identify a stage with a lack of a high density position as well as with a uniform interval of the low density position with density less than the second density value corresponding to the second input gradation value as a stage with no abnormality.

In the twenty sixth aspect, it is preferable to allow the computer to serve as the analysis device to create a detection profile showing a relationship between a reading position and a reading signal value for each of stages constituting the test image in accordance with the acquired reading data on the test image to identify a stage whose detection profile has no difference from a reference profile, which is previously acquired as a base, as a stage with no abnormality in a detection profile.

In the twenty sixth aspect, it is preferable that the reference profile is created from reading data on a test image recorded by using a recording head with no abnormal recording element.

In the twenty sixth aspect, it is preferable that the reference profile is created by extracting portions recorded by a normal recording element in the detection profile created from the reading data on the test image to create copies of the respective extracted portions to join the copies of the respective extracted portions.

In the twenty sixth aspect, it is preferable to allow the computer to serve as the test image acquiring device to acquire a test image including a uniform density portion with the third density value corresponding to the third input gradation value in a recording area of the first recording element and a recording area of the second recording element, and preferable to allow the computer to serve as the analysis device to identify a plurality of recording elements expected to include an abnormal recording element in accordance with an analysis result of the uniform density portion.

In the twenty sixth aspect, it is preferable to allow the computer to serve as the test image acquiring device to acquire a practical image, and preferable to allow the computer to serve as the analysis device to identify a plurality of recording elements expected to include an abnormal recording element in accordance with the acquired practical image.

A twenty seventh aspect provides a computer-readable recording medium that stores an abnormal recording element detection program that allows a computer to serve as:

a test image acquiring device that acquires a test image created in accordance with input data or reading data on the test image, the input data allowing the test image to be formed on a recording medium by allowing a recording head and the recording medium to relatively move in a first direction and a second direction orthogonal to the first direction, in which input data, N representing an integer of 1 or more, a plurality of recording elements selected every N pieces in a projected recording element group of a plurality of recording elements provided in the recording head, projected in the first direction, is indicated as a first recording element and a recording element that is not selected as the first recording element is indicated as a second recording element, the input data allowing a first-stage pattern with a predetermined length to be formed in a recording area of the second recording element in accordance with a second input gradation value in the second direction, and a recording position in the second direction to be sequentially changed, as well as the first recording element and the second recording element to be sequentially switched to form a second-stage pattern to an (N+1)-th-stage pattern; and an analysis device that analyzes the test image acquired to detect an abnormal recording element in the recording head.

The present invention enables abnormal recording element detection by using a test image that realizes a case where recording characteristics of the first recording element depend on recording conditions of the second recording element arranged in a periphery of the first recording element, and where the first recording element has relatively low independent recording characteristics. Performing the abnormal recording element detection using the test image in accordance with the present invention enables an abnormal recording element, which may be problem in recording of a practical image, to be reliably detected.

DETAILED DESCRIPTION OF THE EMBODIMENTS (Description of Test Image)

Figure 1:
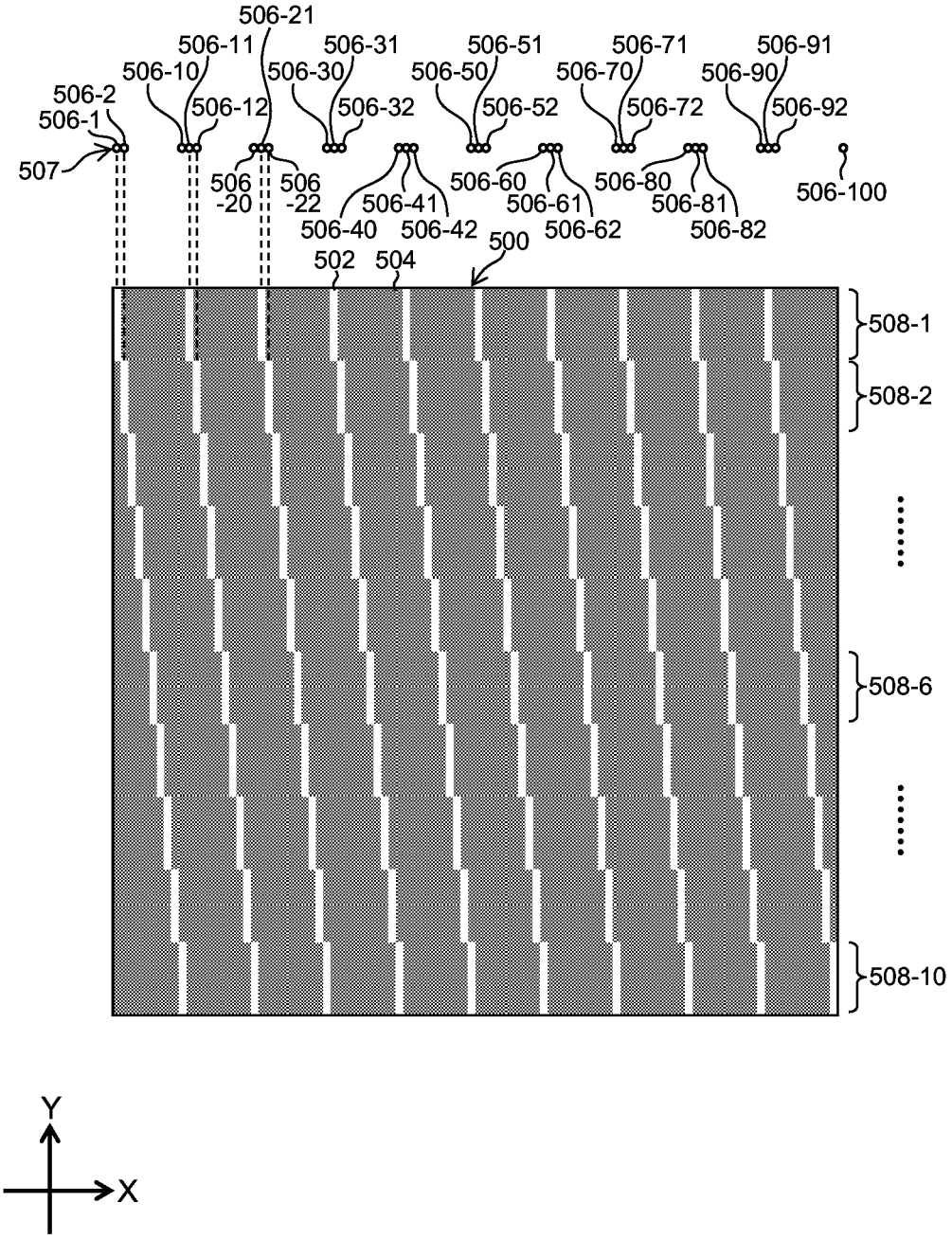
FIG. 1 is an illustration of a test image that is formed by a test image forming system in accordance with an embodiment of the present invention in a case where there is no abnormal recording element.

FIG. 1 is an illustration of a test image that is formed by a test image forming system in accordance with an embodiment of the present invention in a case where there is no abnormal recording element. A test image 500 illustrated in FIG. 1 has an N-on-1-off pattern obtained by inverting a density relationship between a ruled line and a periphery of the ruled line in a 1-on-N-off pattern. N represents an integer of 1 or more. The same applies to descriptions below. In the present specification, terms of formation and recording related to an image and a pattern are appropriately replaceable.

In an upper portion of the test image 500 in FIG. 1, a part of one hundred recording elements 506-1 to 506-100 provided in a recording head that forms the test image 500 is schematically illustrated. A recording element at a left edge in FIG. 1 is indicated as a first recording element and a recording element at a right edge thereof is indicated as a hundredth recording element. Branch numbers of the recording elements 506 are indicated in ascending order from left to right in FIG. 1. A recording element and a reference numeral of a recording element are appropriately omitted for convenience of illustration. The one hundred recording elements 506-1 to 506-100 illustrated in FIG. 1 are arranged in a line along a first direction X at equal intervals. If a plurality of recording elements is arranged in a matrix shape such as nozzle apertures 280 illustrated in FIG. 21, a projected recording element group formed by projecting the plurality of recording elements along the first direction X has the same arrangement of recording elements as that of a projected recording element group 507 composed of the recording elements 506-1 to 506-100 illustrated in FIG. 1. The first direction X shown by an arrow illustrated in FIG. 1 may indicate only one of two directions shown by the arrow as the first direction X. The same applies to a second direction Y.

Examples of a recording head include an ink jet recording head and an electrophotographic recording head. The recording element device represents a minimum unit of recording an image in a recording head, such as a nozzle in the ink jet recording head and an LED element in the electrophotographic recording head. LED is an abbreviation of a light emitting diode.

The test image 500 includes ruled line portions 502, and portions between-ruled-lines 504. The ruled line portion 502 has the same width in the first direction X as a unit recording width, and corresponds to a ruled line in a 1-on-N-off test image. The portion between-ruled-lines 504 has a width in the first direction X that is N times larger than the unit recording width, and corresponds to a portion between-ruled-lines in the 1-on-N-off test image. The unit recording width is a minimum width of a line recorded by one recording element, and is synonymous with a one-dot width and a dot diameter.

The test image 500 is recorded by using the projected recording element group 507 including the one hundred recording elements 506-1 to 506-100 arranged along the first direction at equal intervals while a recording head and a recording medium are relatively moved along the second direction Y orthogonal to the first direction X.

N represents an integer of 1 or more, and recording elements determined every N pieces in the projected recording element group 507 are indicated as the first recording elements, as well as N recording elements between the first recording elements are indicated as second recording elements. Then, the portions between-ruled-lines 504, with a predetermined length in the second direction, are recorded by using the second recording elements to record a first stage pattern 508-1 from the top of the test image 500 in FIG. 1.

In an example illustrated in FIG. 1, when the portions between-ruled-lines 504 in the first stage pattern 508-1 from the top of the test image 500 in FIG. 1 are recorded, recording elements 506-1, 506-11, 506-21, 506-31, 506-41, 506-51, 506-61, 506-71, 506-81, and 506-91 are selected as the first recording elements. That is, the test image 500 illustrated in FIG. 1 is an example in a case where N representing the number of intervals of the first recording elements is nine.

In addition, when the portions between-ruled-lines 504 in the first stage pattern 508-1 from the top of the test image 500 in FIG. 1 are recorded, recording elements 506-2 to 506-10, 506-12 to 506-20, 506-22 to 506-30, 506-42 to 506-50, 506-52 to 506-60, 506-62 to 506-70, 506-72 to 506-80, 506-82 to 506-90, and 506-92 to 506-100, are set as the second recording elements.

Then, image recording from a second stage pattern 508-2 to a tenth stage pattern 508-10 from the top of the test image 500 in FIG. 1 is performed by sequentially changing a recording position in the second direction Y as well as by sequentially switching between the first recording element and the second recording element.

A length of each stage in the second direction is determined depending on factors such as: the number of stages of the test image 500; reading conditions of a test image, such as reading speed and definition of a reading device like a scanner for reading the test image 500; conditions of a space where the test image 500 is to be recorded; and conditions of a recording head. It is preferable that the length of each stage in the second direction is uniform.

Aspects of sequentially changing the recording position in the second direction Y include an aspect in which respective stages are continuously formed, and an aspect in which a non-recording area is formed between respective stages. Aspects of sequentially switched between the first recording element and the second recording element include an aspect of switching in the order of arrangement, and an aspect of switching at intervals of one pattern, two patterns, or the like.

That is, if regularity enabling analysis of a test image is secured in the test image 500 in FIG. 1, such as in the order of first, third, fifth, seventh, ninth, second, fourth, sixth, eighth, and tenth stages, the order of each of the stages is may be changed.

As illustrated in FIG. 1, the test image recorded by using the test image forming method in accordance with the present embodiment is formed by recording the portion between-ruled-lines 504 at an off-position in a 1-on-N-off test image by using the second recording element to enable the test image to be formed under recording conditions with a little difference from those where a practical image is recorded, or under recording conditions similar to those where the practical image is recorded.

The test image is formed in a case where the recording characteristics of the first recording element depend on recording conditions of the second recording element arranged in a periphery of the first recording element, and relatively low independent recording characteristics of the first recording element are realized in the test image. Performing abnormal recording element detection by using the test image enables an abnormal recording element, which may be a problem in recording of a practical image, to be reliably detected.

Figure 14:
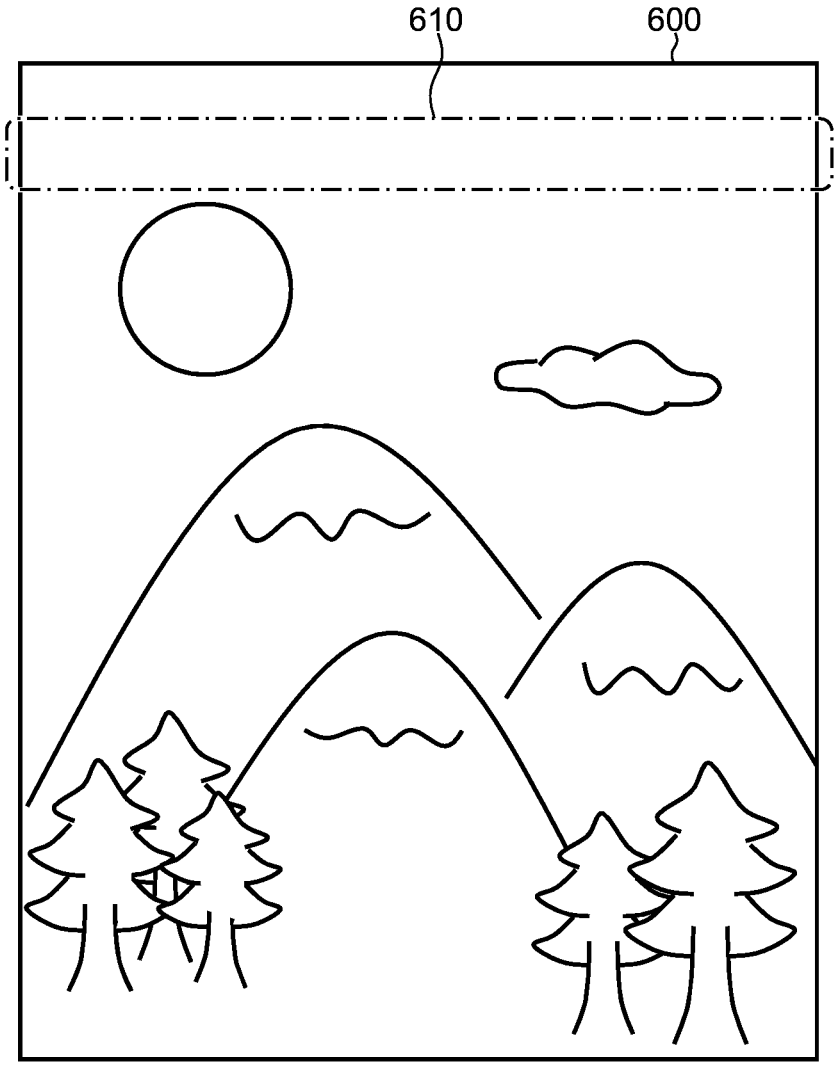
FIG. 14 is an illustration of identification of a position of an abnormal recording element by using a practical image.

The practical image is recorded by using an image recorder, and includes an image to be printed on a printed matter that is produced by a request from a user. An example of the practical image is illustrated in FIG. 14. Image recording by using a full line type head in which a plurality of recording elements is arranged in the first direction X throughout a length corresponding to a full length of a recording medium allows uneven density such as a white streak and a black streak along the second direction Y to occur due to abnormality in any recording element, thereby deteriorating image quality.

Since an abnormal recording element occurs not only in an initial state but also after a recording head is used, detecting an abnormal recording element at regular intervals enables measures to be taken to reduce deterioration in image quality by applying processing such as correction processing to a recording position of an abnormal recording element.

The test image 500 illustrated in FIG. 1 includes the ruled line portion 502 with a first density value corresponding to the first input gradation value less than the second input gradation value, and the portion between-ruled-lines 504, with the second density value corresponding to the second input gradation value more than the first input gradation value, the second density value allowing the ruled line portion 502 with the first density value to be distinguished from the portion between-ruled-lines 504.

In the test image 500 illustrated in FIG. 1, the first input gradation value of the ruled line portion 502 is a minimum value within a numeric value range of possible input gradation values. For example, a gradation value corresponding to non-recording is the minimum value within the numeric value range of the possible input gradation values. The second input gradation value of the portion between-ruled-lines 504 is a maximum value within the range of the possible input gradation values. For example, the numeric value range of the possible input gradation values is a range from 0 to 255 in 8-bit digital data.

The first input gradation value and the second input gradation value are appropriately changeable within a range in which the ruled line portion 502 and the portion between-ruled-lines 504 are distinguishable in analysis of the test image 500.

As with the test image 500 illustrated in FIG. 1, a test image recorded by using a recording head with one hundred recording elements, in which the number N of intervals of the first recording elements is nine and the number of stages is ten, will be described below.

Figure 2:
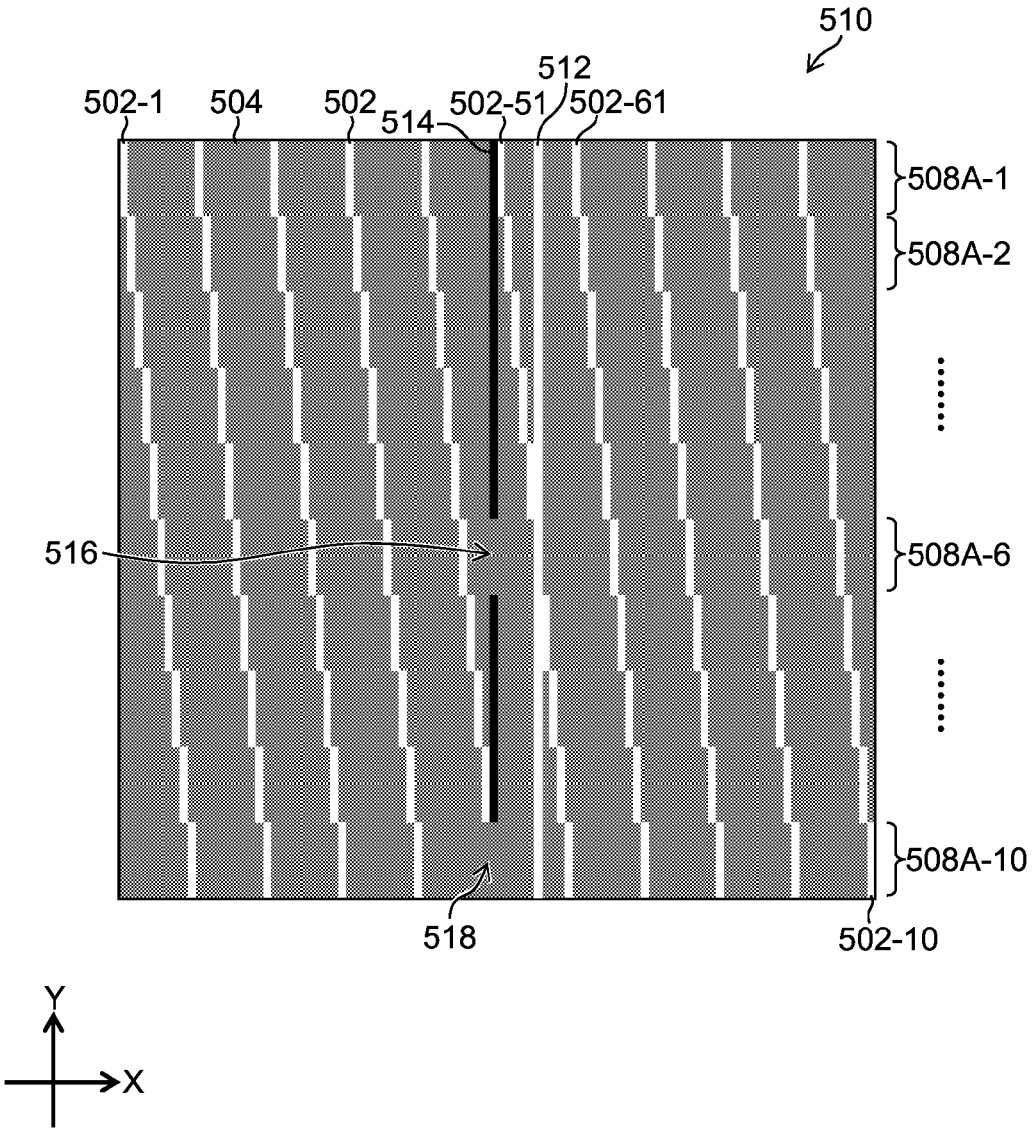
FIG. 2 is an illustration of a test image that is recorded by the test image forming system in accordance with the embodiment of the present invention in a case where there is an abnormal recording element.
Figure 3:
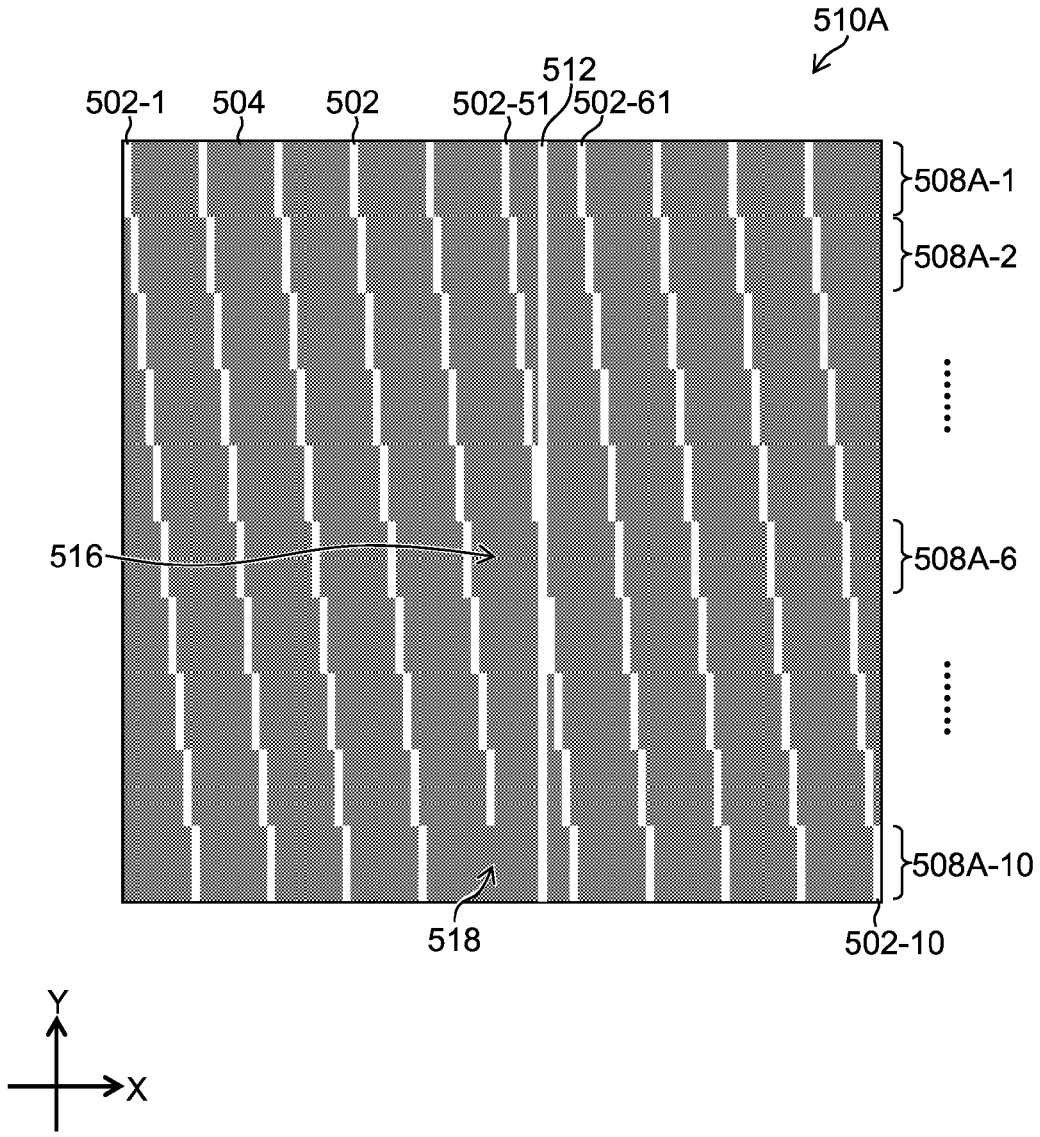
FIG. 3 is an illustration of another example of a test image that is recorded by the test image forming system in accordance with the embodiment of the present invention, and that has an abnormal recording element.
Figure 4:
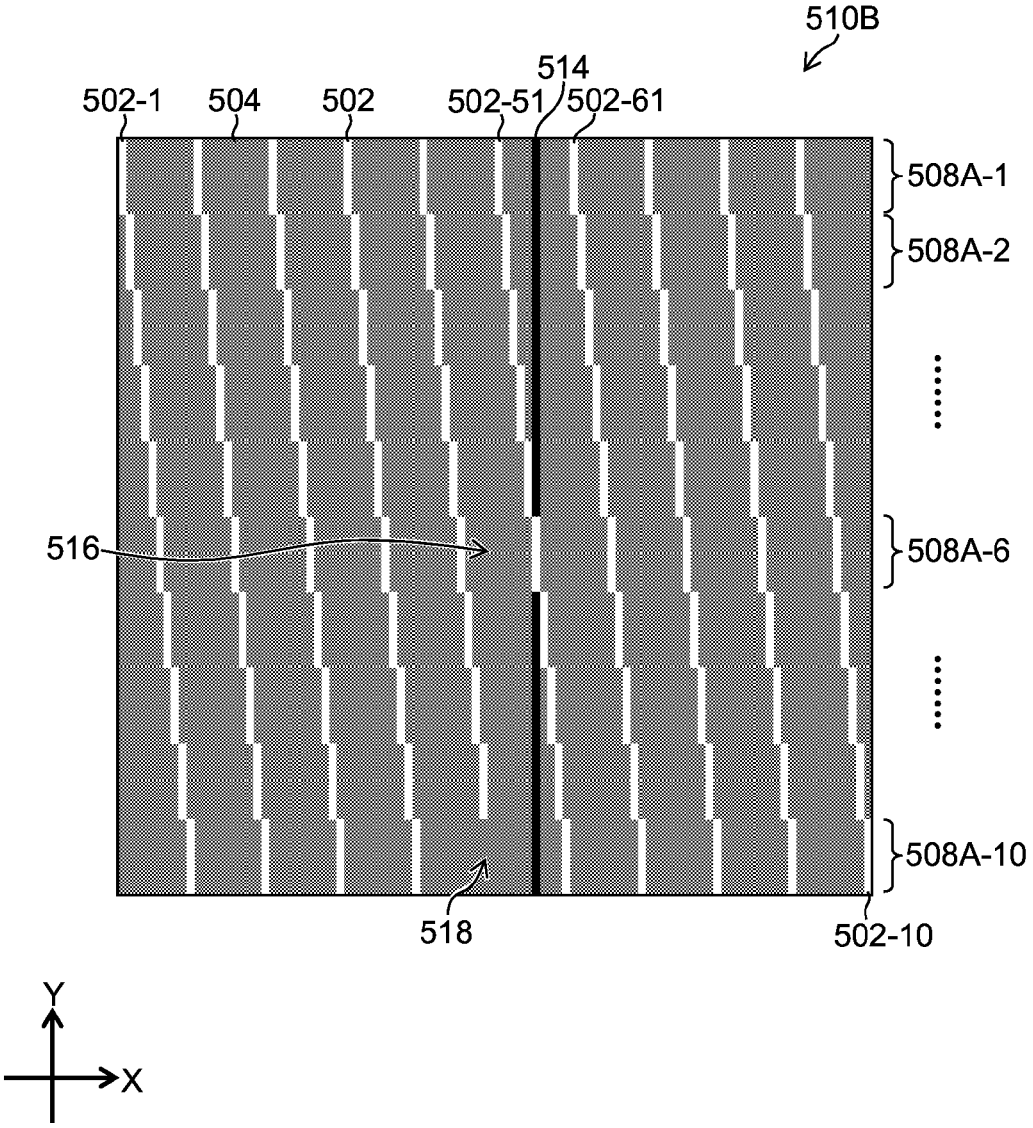
FIG. 4 is an illustration of another example of a test image that is recorded by the test image forming system in accordance with the embodiment of the present invention, and that has an abnormal recording element.

FIG. 2 is an illustration of a test image that is formed by the test image forming system in accordance with the embodiment of the present invention in a case where there is an abnormal recording element. Each of FIGS. 3 and 4 is an illustration of another example of a test image that is recorded by the test image forming system in accordance with the embodiment of the present invention, and that has an abnormal recording element. In FIGS. 2 to 4, a portion common to that illustrated in FIG. 1 is designated by the same reference numeral as that of FIG. 1 to appropriately omit a description thereof.

In FIG. 2, the projected recording element group 507 illustrated in FIG. 1 is omitted. A branch number attached to the ruled line portion 502 shows a number of a recording element that has recorded the ruled line portion 502.

A test image 510 illustrated in FIG. 2 is recorded by using the same input data as that used for the test image 500 illustrated in FIG. 1, and is recorded by using a recording head with an abnormal recording element.

For example, the abnormal recording element includes recording elements such as failing to perform recording, causing a recording position to be displaced beyond a normal range, and causing excess or insufficient recording density beyond a normal range.

The test image 510 illustrated in FIG. 2 has a white streak 512 and a black streak 514 that are recorded along the second direction Y. The black streak 514 has missing portions 516 and 518 in sixth and tenth stages from the top of FIG. 2, respectively.

If the test image 510 including the white streak 512 and the black streak 514 illustrated in FIG. 2 is recorded, it is possible to determine that there is an abnormal recording element. In addition, if a test image 510A including only the white streak 512 and without the black streak 514 illustrated in FIG. 3, or a test image 510B including only the black streak 514 and without the white streak 512 illustrated in FIG. 4, is recorded, it is also possible to determine that there is an abnormal recording element.

Meanwhile, if the test image 500 illustrated in FIG. 1 without the white streak 512 and the black streak 514 illustrated in FIG. 2 is recorded, it is also possible to determine that there is no abnormal recording element. In FIG. 2, reference numerals 508A-1 and 508A-2 designate first and second stage patterns of the test image 510, respectively.

Figure 5:
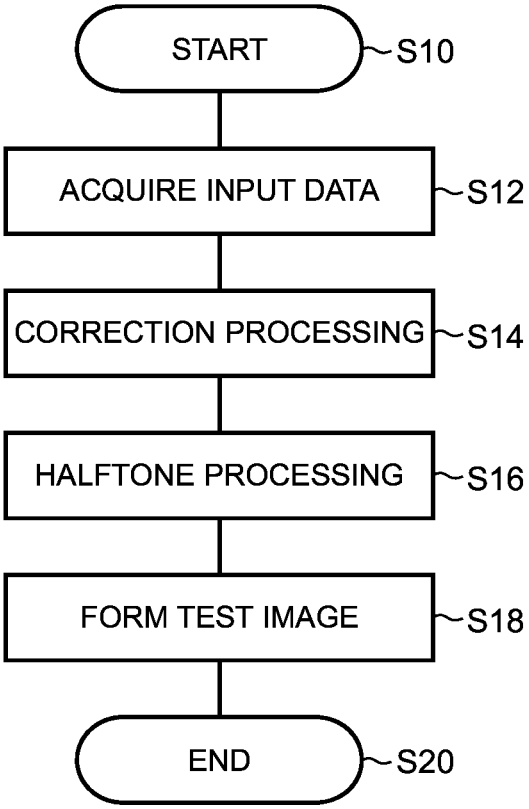
FIG. 5 is a flow chart illustrating a flow of control of a test image forming method in accordance with the embodiment of the present invention.

FIG. 5 is a flow chart illustrating a flow of control of a test image forming method in accordance with the embodiment of the present invention. When formation of a test image is started in starting step S10, input data for forming the test image is acquired in input data acquiring step S12.

For example, acquiring of input data is reading out of input data for forming a test image that is previously stored. An example of the input data for forming a test image is input data in which a recording element positioned to record the ruled line portion 502 of FIGS. 1 and 2 is indicated as the first recording element and a recording element positioned to record the portion between-ruled-lines 504 is indicated as the second recording element, the input data allowing the portion between-ruled-lines 504 in the first stage pattern 508-1 to be formed by using the second recording element and a recording position in the second direction to be sequentially changed, as well as sequentially switching between the first recording element and the second recording element to form the portion between-ruled-lines 504 in each of the second to tenth stage patterns 508-2 to 508-10, thereby forming a test image composed of the 10 stages. The first input gradation value less than the second input gradation value is applied to a recording position of the first recording element, and the second input gradation value more than the first input gradation value is applied to a recording area of the second recording element. The first input gradation value may set at a gradation value corresponding to non-recording. The recording area of the second recording element is an area where a plurality of recording positions of the second recording element continues.

A recording head with no abnormal recording element records the test image 500 illustrated in FIG. 1, and a recording head with an abnormal recording element records the test image 510 illustrated in FIG. 2, or a test image including only the white streak 512 or a test image including only the black streak 514.

After the input data is acquired, processing proceeds to correction processing step S14. In correction processing in the correction processing step S14, there are applied gamma correction processing for correcting nonlinearity between an input gradation value of input data and a density value of a test image, and unevenness correction processing for correcting recording characteristics for each of recording elements.

After the correction processing is applied to the input data, the processing proceeds to halftone processing step S16. In the halftone processing step S16, halftone processing is applied to the input data after the correction processing to create binary halftone data or halftone data with a multiple value less than the number of gradation of the input data. A halftone pattern used in recording of a practical image is applied to the halftone processing step S16.

For example, the halftone pattern includes a dither matrix, a threshold value matrix, and the like. The halftone data is acquired by the halftone processing in which arrangement of dots for each of pixels, a size of the dots, and the like, are defined in accordance with the input data. The halftone data is sometimes called dot data and the like.

After the halftone data is created in the halftone processing step S16, the processing proceeds to test image forming step S18 to form a test image by using a recording head.

In the test image forming step S18, a recording element positioned to record the ruled line portion 502 of FIGS. 1 and 2 is indicated as the first recording element and a recording element positioned to record the portion between-ruled-lines 504 is indicated as the second recording element, and then the portion between-ruled-lines 504 in the first stage pattern 508-1 is formed by using the second recording element. Subsequently, a recording position in the second direction is sequentially changed, as well as the first recording element and the second recording element are sequentially switched, to form the portion between-ruled-lines 504 in each of the second to tenth stage patterns 508-2 to 508-10, thereby forming a test image composed of the 10 stages. After the test image is recorded, the processing proceeds to ending step S20 to finish forming of a test image.

The test image forming step S18 illustrated in FIG. 5 includes driving voltage creating step of creating driving voltage of a recording head from the halftone data created by the halftone processing step S16, and recording head driving step of forming a test image by operating the recording head using the driving voltage created.

Figure 6:
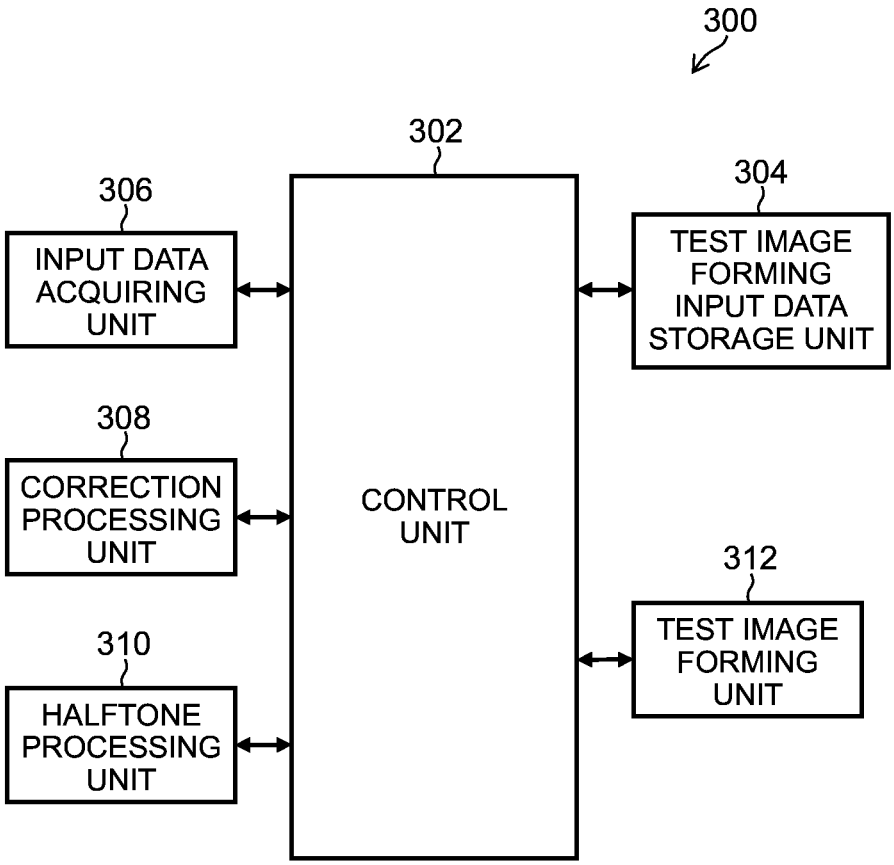
FIG. 6 is a block diagram illustrating a schematic configuration of a test image forming system in accordance with the embodiment of the present invention.

FIG. 6 is a block diagram illustrating a schematic configuration of a test image forming system in accordance with the embodiment of the present invention. A test image forming system 300 illustrated in FIG. 6 includes a control unit 302, an input data forming a test image storage unit 304, an input data acquiring unit 306, a correction processing unit 308, a halftone processing unit 310, and a test image forming unit 312.

The test image forming system 300 is integrally controlled by the control unit 302. That is, the control unit 302 transmits a command signal of operating each of units to each of the units. The control unit 302 also serves a memory controller for controlling reading out of test image data from the input data forming a test image storage unit 304.

The input data forming a test image storage unit 304 stores input data for forming a test image, which is to be input data at the time when a test image is formed. Input data for forming a test image corresponding to each of a plurality of recording heads may be stored. In addition, input data for forming a test image corresponding to each of conditions of test image forming may be stored.

The input data acquiring unit 306 acquires input data to be used at the time of forming a test image. The input data may be read out from the input data forming a test image storage unit 304 or may be acquired from the outside of the system. The input data acquiring unit 306 corresponds to the input data acquiring step S12 illustrated in FIG. 5.

The correction processing unit 308 applies correction processing to the input data acquired. The gamma correction processing, and the unevenness correction processing, to be performed in the correction processing step S14 illustrated in FIG. 5, is applied to the correction processing. The correction processing unit 308 illustrated in FIG. 6 corresponds to the correction processing step S14 illustrated in FIG. 5.

The halftone processing unit 310 illustrated in FIG. 6 applies the halftone processing to the input data to which the correction processing has been applied. The halftone processing unit 310 corresponds to the halftone processing step S16 illustrated in FIG. 5.

The test image forming unit 312 forms a test image in accordance with the halftone data created by the halftone processing. The test image forming unit 312 includes a driving voltage creating unit that creates driving voltage of the recording head from the halftone data, and a driving voltage supplying unit that supplies the driving voltage to the recording head.

The test image forming unit 312 illustrated in FIG. 6 corresponds to the test image forming step S18 illustrated in FIG. 5. Appropriate variation, addition, and elimination in the configuration of the test image forming system 300 illustrated in FIG. 6 are possible.

It is possible to configure a test image forming program for controlling the test image forming method illustrated in FIG. 5, and the test image forming system 300 illustrated in FIG. 6. That is, it is possible to configure the test image forming program that allows a computer to serve as: an input data acquiring device corresponding to the input data acquiring unit 306; and a test image forming device corresponding to the test image forming unit 312.

It is also possible to allow the computer to serve as: an input data for forming a test image storage device corresponding to the input data for forming a test image storage unit; a correction processing device corresponding to the correction processing unit; a halftone processing device corresponding to the halftone processing unit; a driving voltage creating device corresponding to the driving voltage creating unit; and a driving voltage supply device corresponding to the driving voltage supplying unit.

It is possible to create a computer-readable storage medium that stores a test image forming program that allows a computer to serve as: the input data acquiring device corresponding to the input data acquiring unit 306; and the test image forming device corresponding to the test image forming unit 312.

In addition, it is possible to create a storage medium that stores a test image created in accordance with input data for forming a test image, used in a test image forming system that relatively moves a recording head and a recording medium in the second direction Y orthogonal to the first direction X to form the test image on a recording medium, in which input data, N representing an integer of 1 or more, a plurality of recording elements selected every N pieces in the projected recording element group 507 of FIG. 1 is indicated as a first recording element and a recording element that is not selected as the first recording element is indicated as a second recording element, and the input data allows a first-stage pattern with a predetermined length to be formed in a recording area of the second recording element in accordance with a second input gradation value in the second direction, and allows a recording position in the second direction to be sequentially changed as well as the first recording element and the second recording element to be sequentially switched to form a second-stage pattern to an (N+1)-th-stage pattern.

(Description of Abnormal Recording Detection Method)

Figure 7:
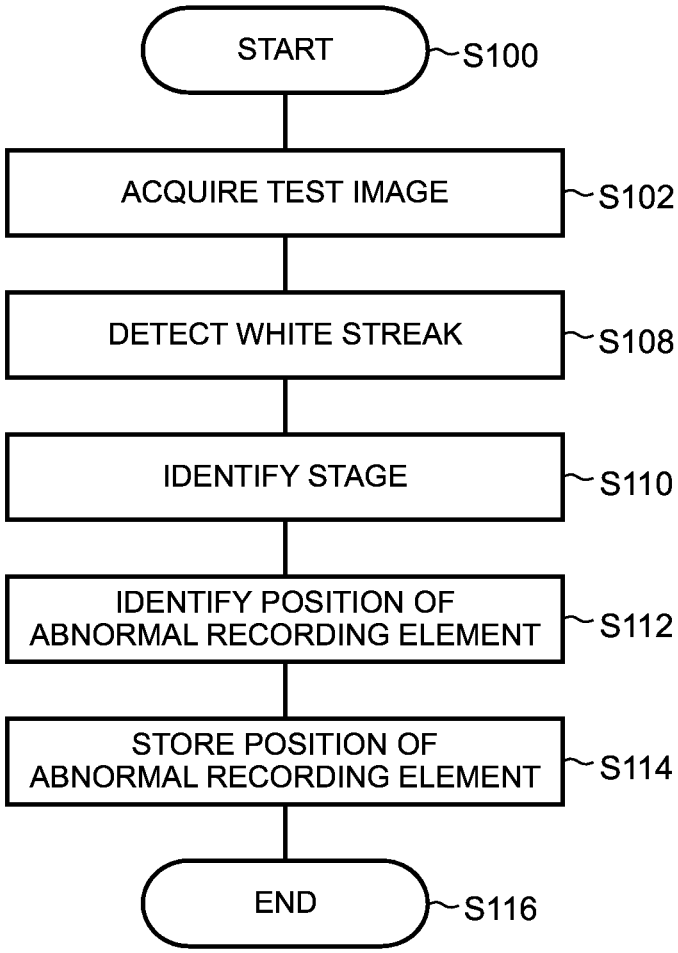
FIG. 7 is a flow chart illustrating a flow of a procedure of an abnormal recording element detection method in accordance with the embodiment of the present invention.

FIG. 7 is a flow chart illustrating a flow of a procedure of an abnormal recording element detection method in accordance with the embodiment of the present invention. A case where the test image 510 illustrated in FIG. 2 is formed will be mainly described with appropriate reference to FIGS. 1 to 6.

In starting step S100 illustrated in FIG. 7, abnormal recording element detection is started. First, a test image is acquired in test image acquiring step S102. After the test image is acquired, processing proceeds to white streak detection step S108.

The test image may be acquired from a recording medium on which the test image is recorded by using a recording head, or may be acquired from reading data created by reading the test image using a reading device such as a scanner.

In the white streak detection step S 108, it is detected whether the test image includes a white streak or not. If a white streak such as the white streak 512 in the test image 510 illustrated in FIG. 2 is detected, it is possible to determine that there is an abnormal recording element.

In the white streak detection step S108 illustrated in FIG. 7, a rough position of an abnormal recording element is detected from a position of the white streak. That is, the white streak occurs because an abnormal recording element fails to perform recording at a required recording position. The white streak is a low density position with a density value less than the second density value that is a standard density value of the portion between-ruled-lines 504. Information on a position of the white streak enables the rough position of the abnormal recording element, which is a plurality of recording elements expected to include the abnormal recording element, to be identified.

Since the white streak 512 in the test image 510 illustrated in FIG. 2 is positioned in a space between a ruled line portion 502-51 corresponding to a fifty first recording element 506-51 and a ruled line portion 502-61 corresponding to a sixty first recording element 506-61, a space between a recording position of the fifty first recording element 506-51 and a recording position of the sixty first recording element 506-61 is identified as an area including the abnormal recording element, whereby the recording elements 506-51 to 506-61 are identified as the plurality of recording elements expected to include the abnormal recording element.

Retuning to FIG. 7, after the rough position of the white streak that is the plurality of recording elements expected to include the abnormal recording element is identified in the white streak detection step S108, stage identifying step S110 of identifying a stage with no abnormal recording is performed. In the test image 510 illustrated in FIG. 2, no abnormal recording is found in a sixth stage pattern 508A-6 from the top of FIG. 2. A stage in which no abnormal recording is found in the test image 510 illustrated in FIG. 2 has uniform intervals between the ruled line portions 502.

After the stage identifying step S110 is finished, the processing proceeds to abnormal recording element position identifying step S112 to acquire a position of the abnormal recording element from the stage identified in the stage identifying step S110. Then, a fifty sixth recording element 506-56 that is a sixth recording element from the fifty first recording element 506-51 is identified as the abnormal recording element.

The white streak detection step S108, the stage identifying step S110, and the abnormal recording element position identifying step S112, illustrated in FIG. 7, serve as analysis step of analyzing a test image. After the position of the abnormal recording element is identified, the processing proceeds to abnormal recording element position storage step S114 to store the position of the abnormal recording element, and then proceeds to ending step S116 to finish the abnormal recording element detection.

An abnormal recording element number may be stored as a position of an abnormal recording element. In addition, an abnormal cause of the abnormal recording element may be stored in association with the abnormal recording element number. Analyzing a test image from such a viewpoint enables presence or absence of an abnormal recording element and a position of the abnormal recording element to be identified.

The test image 510 illustrated in FIG. 2 has both the white streak 512 and the black streak 514. A black streak occurs because an abnormal recording element performs recording at a position different from a required recording position. The black streak is a high density position with a density value more than the second density value that is the standard density value of the portion between-ruled-lines 504.

If the test image 510 including the white streak 512 and the black streak 514 illustrated in FIG. 2 is formed, it is possible to grasp that there is an abnormal recording element that causes a position shift in recording.

If the test image 510A including only the white streak 512 and without the black streak 514 illustrated in FIG. 3 is formed, it is possible to grasp that there is a non-recording abnormal recording element or an abnormal recording element that causes insufficient recording density.

If the test image 510B including only the black streak 514 and without the white streak 512 illustrated in FIG. 4 is formed, it is possible to grasp that there is an abnormal recording element that causes excessive recording density.

That is, grasping that a recorded test image corresponds to which of the test image 510, 510A, and 510B illustrated in FIGS. 2 to 4, respectively, enables presence or absence of an abnormal recording element to be grasped, as well as a kind of abnormality in the abnormal recording element to be grasped.

In the test image 510 illustrated in FIG. 2, it is possible to grasp an interval of a position shift in recording of an abnormal recording element, from a position of the black streak 514.

Then, in the test image 510 illustrated in FIG. 2, a stage missing a black streak may be identified in the stage identifying step S110. The black streak 514 in the test image 510 illustrated in FIG. 2 has the missing portions 516 and 518 in the sixth stage pattern 508A-6 and a tenth stage pattern 508A-10 from the top of FIG. 2, respectively.

The sixth stage pattern 508A-6 from the top of the test image 510 illustrated in FIG. 2 is the same as the sixth stage pattern 508-6 from the top of the test image 500 illustrated in FIG. 1. The test image 510 includes the black streak 514 that has the missing portion 516. The missing portion 516 of the black streak 514 occurs because a fifty sixth recording element fails to perform recording in the sixth stage pattern 508A-6 from the top of the test image 510 of FIG. 2.

Detecting the missing portion 516 of the black streak 514 in the stage identifying step S110 allows stages for which uniformness of intervals of the ruled line portions 502 is to be checked to be reduced to enable a position of an abnormal recording element to be identified at higher speed.

The missing portion 518 of the black streak 514 in the tenth stage pattern 508A-10 from the top of the test image 510 of FIG. 2 occurs because required recording by a fiftieth recording element is not performed and the fifty sixth recording element performs recording at a position where the ruled line portion 502 should be recorded to result in the same density as that of the portion between-ruled-lines 504.

If the test image 510A illustrated in FIG. 3 is formed, it is possible to grasp presence or absence of an abnormal recording element by using the same procedure as that in a case where the test image 510 illustrated in FIG. 2 is formed to enable a position of the abnormal recording element to be identified.

If the test image 510B illustrated in FIG. 4 is formed, step of analyzing a black streak to identify a rough position of an abnormal recording element may be performed in the white streak detection step S108 of FIG. 7. In addition, the step of analyzing a black streak to identify a rough position of an abnormal recording element may be performed after the white streak detection step S108 of FIG. 7 as black streak detection step.

In the analysis of a white streak described before, replacing the white streak with a black streak enables analysis of the black streak. Then, in the stage identifying step S110 illustrated in FIG. 7, identifying a stage without an abnormal recording enables a position of an abnormal recording element to be grasped from the identified stage.

In the test image 510B illustrated in FIG. 4, a stage in which no abnormal recording is found is a stage 508A-6 having the missing portion 516 of the black streak 514, with uniform intervals of the ruled line portions 502.

Figure 8:
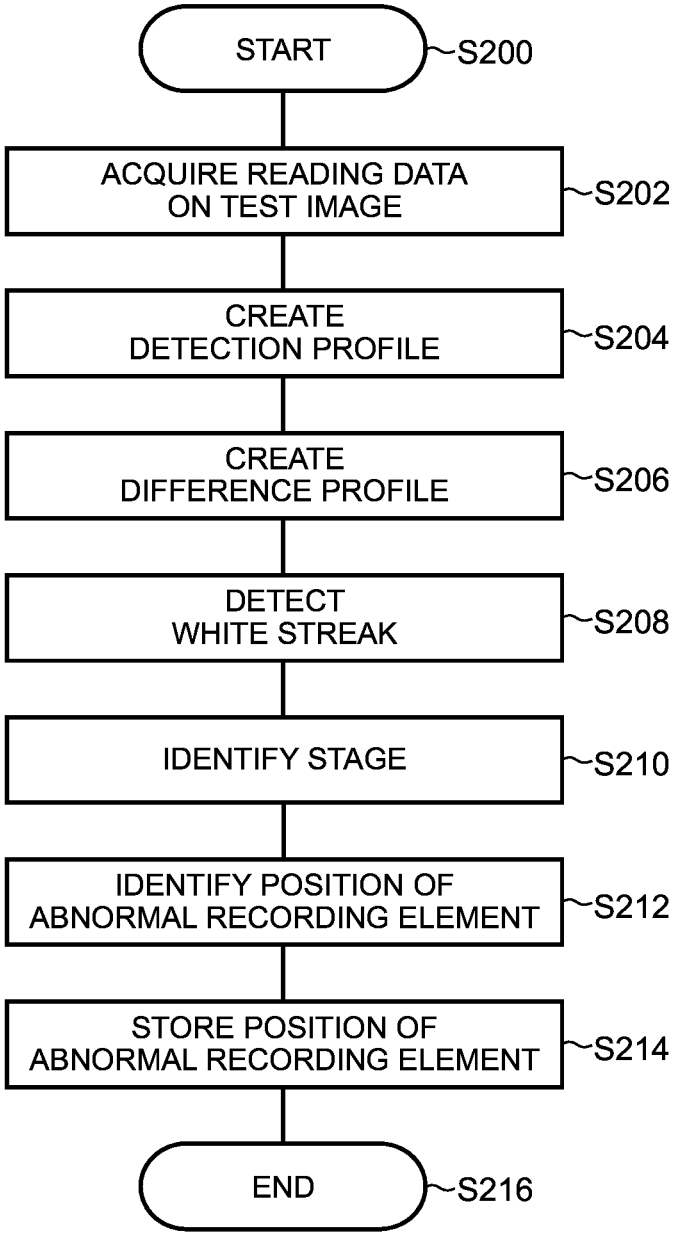
FIG. 8 is a flow chart illustrating a flow of a procedure of an abnormal recording element detection method in accordance with the embodiment of the present invention in a case of performing automatic detection.

FIG. 8 is a flow chart illustrating a flow of a procedure of an abnormal recording element detection method in accordance with the embodiment of the present invention in a case of performing automatic detection of an abnormal recording element in accordance with reading data on a test image.

In starting step S200, abnormal recording element detection is started. First, in test image reading step S202, the test image 510 illustrated in FIG. 2 is read out by a scanner to acquire reading data on the test image 510 created.

Figure 11:
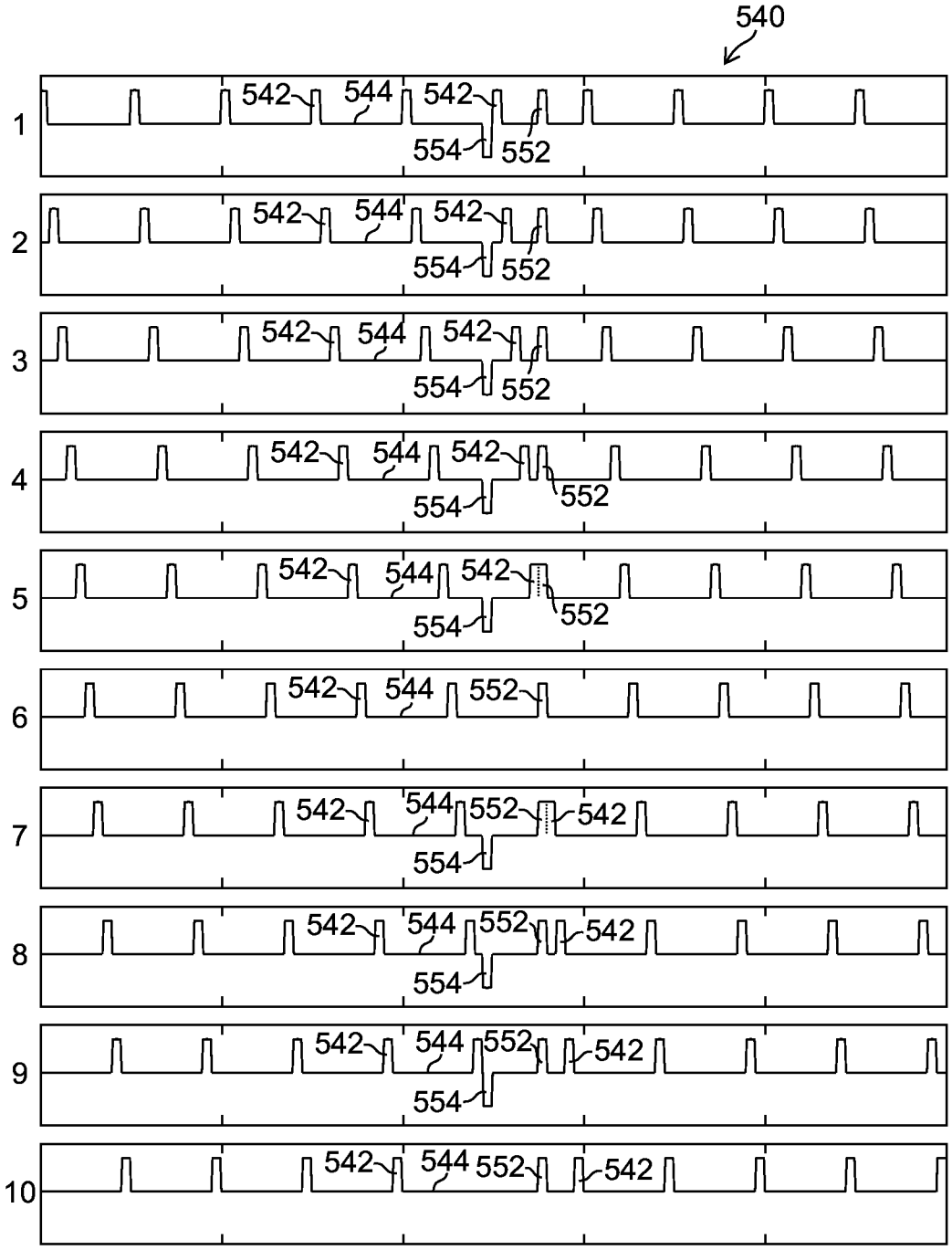
FIG. 11 is an illustration of a detection profile.

After the reading data on the test image 510 is acquired, a detection profile of the reading data on the test image 510 is created in detection profile create step S204 of FIG. 8, and then processing proceeds to difference profile create step S206. FIG. 11 illustrates a detection profile 540 created from the reading data on the test image 510.

In the difference profile create step S206 of FIG. 8, a reference profile previously acquired is subtracted from the detection profile created from the reading data on the test image to create a difference profile. It is possible to create the reference profile from reading data on a test image recorded by using a normal recording head with no abnormal recording element.

Figure 10:
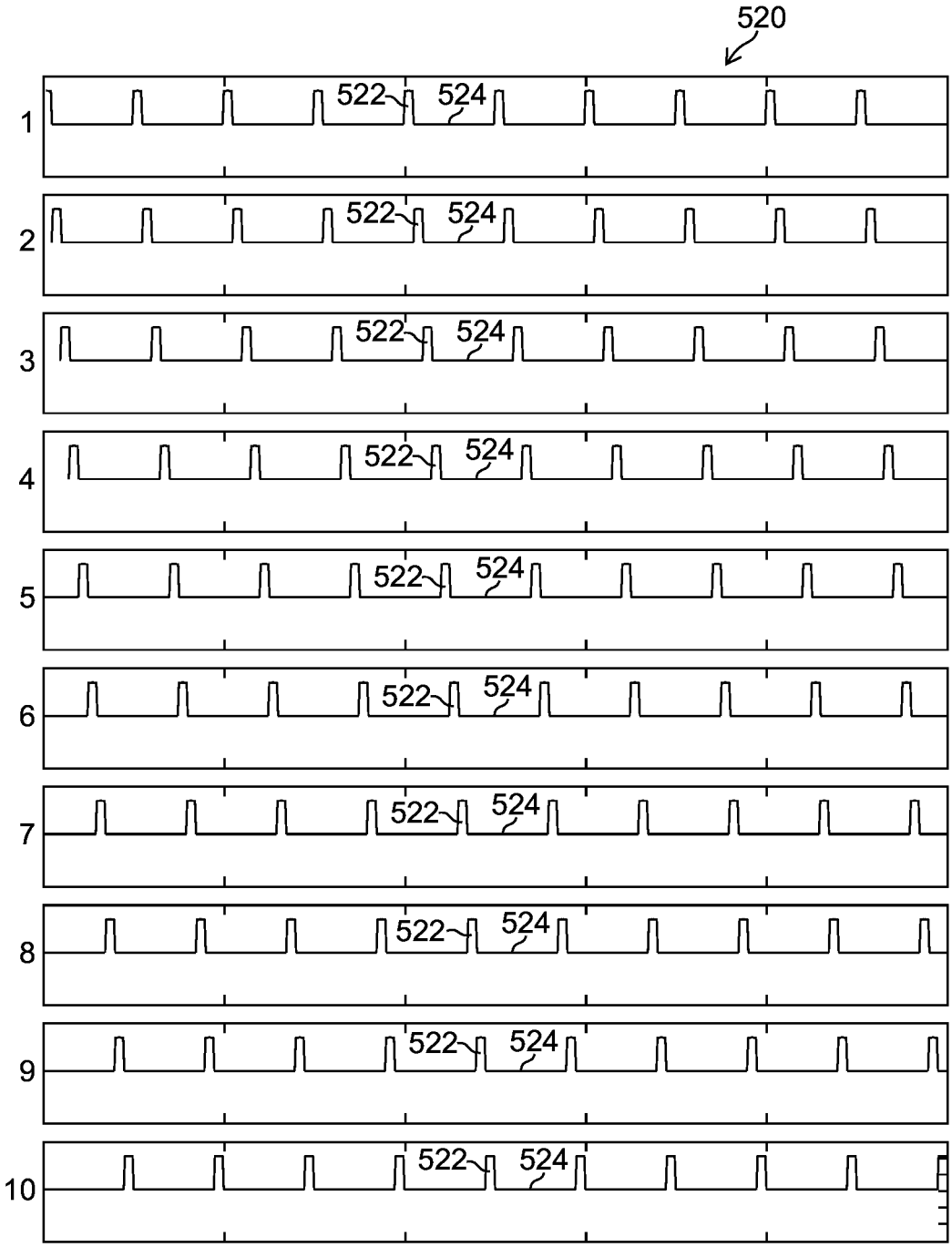
FIG. 10 is an illustration of a reference profile.
Figure 12:
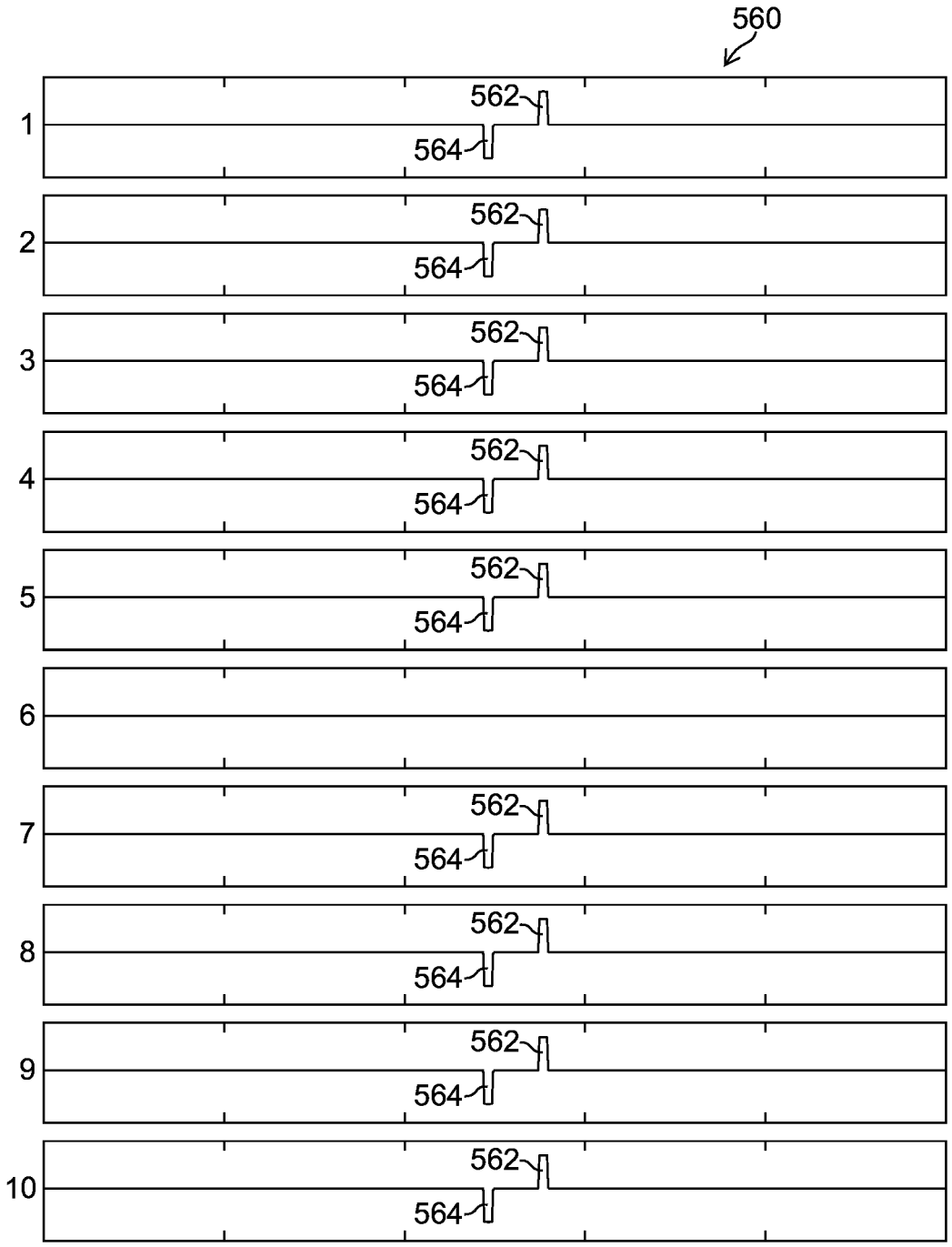
FIG. 12 is an illustration of a difference profile.

FIG. 10 illustrates a reference profile 520 created from the reading data on the test image 500 of FIG. 1. FIG. 12 illustrates a difference profile 560.

After the difference profile is created, the processing proceeds to white streak detection step S208 of FIG. 8 to detect a white streak from the difference profile created. Then, the processing proceeds to stage identifying step S210 to detect a stage with a specific pattern from the difference profile created. The stage with a specific pattern includes an area close to an occurrence position of the white streak, with a uniform signal value without a signal showing the white streak, the stage having only a flat portion.

Next, in abnormal recording element position identifying step S212, a position of an abnormal recording element is identified in accordance with information on the white streak and on the stage with a specific pattern, then the processing proceeds to abnormal recording element position storage step S214 to store the position of the abnormal recording element. After the position of the abnormal recording element is stored, the abnormal recording element detection is finished. A kind of abnormality of the abnormal recording element may be detected to be stored.

The detection profile create step S204, the difference profile create step S206, the white streak detection step S208, the stage identifying step S210, and the abnormal recording element position identifying step S212, illustrated in FIG. 8, serve as analysis step of analyzing a test image.

If the test image 510A illustrated in FIG. 3 is formed as well as the test image 510B illustrated in FIG. 4 is formed, it is possible to grasp presence or absence of an abnormal recording element in accordance with the procedure described with reference to FIG. 7 to enable a kind of abnormality of an abnormal recording element to be identified.

If the test images 510, 510A, and 510B, illustrated in FIGS. 2 to 4, respectively, are mixed in one test image, it is possible to grasp presence or absence of an abnormal recording element by separating the white streak 512 and the black streak 514 in the one test image for individual analysis to enable a kind of abnormality of an abnormal recording element to be identified.

Figure 9:
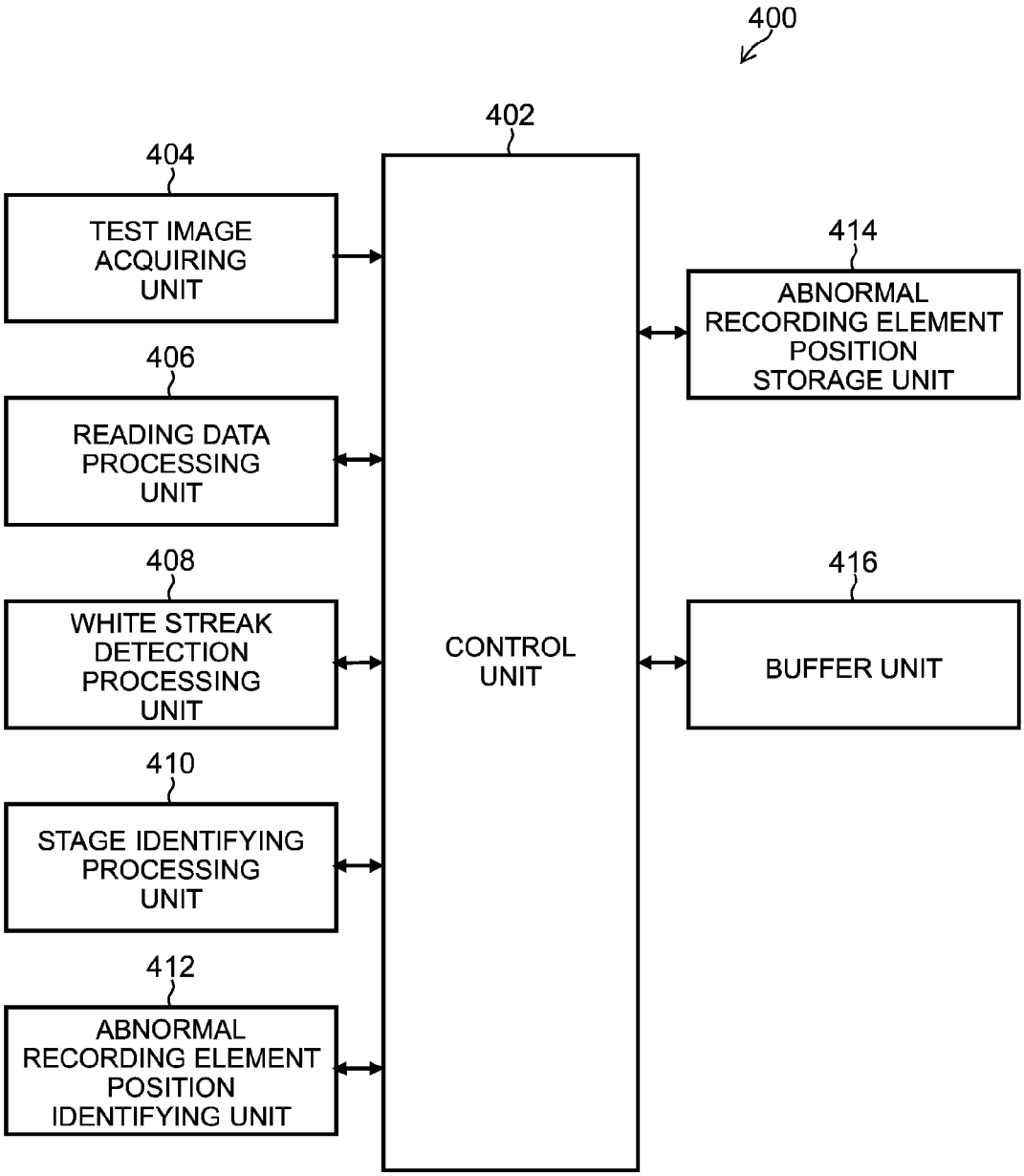
FIG. 9 is a block diagram illustrating a schematic configuration of an abnormal recording element detection system in accordance with the embodiment of the present invention.

FIG. 9 is a block diagram illustrating a schematic configuration of an abnormal recording element detection system in accordance with the embodiment of the present invention. An abnormal recording element detection system 400 illustrated in FIG. 9 includes a control unit 402, a test image acquiring unit 404, a reading data processing unit 406, a white streak detection processing unit 408, a stage identifying processing unit 410, an abnormal recording element position identifying unit 412, an abnormal recording element position storage unit 414, and a buffer unit 416.

The abnormal recording element detection system 400 is integrally controlled by the control unit 402. That is, the control unit 402 transmits a command signal of operating each of units to each of the units. The control unit 402 serves as a control device.

The test image acquiring unit 404 acquires a test image or reading data on the test image. The test image acquiring unit 404 corresponds to the test image reading step S202 illustrated in FIG. 8. In addition, the test image acquiring unit 404 serves as a test image acquiring device.

The reading data processing unit 406 applies processing to the test image or the reading data on the test image, which is acquired. For example, the processing includes processing of creating profile of reading data on test image, and processing of extracting a difference, in the automatic detection of an abnormal recording element illustrated in FIG. 8. The reading data processing unit 406 corresponds to the detection profile create step S204, and the difference profile create step S206, illustrated in FIG. 8.

Another example of the processing of the reading data processing unit 406 of FIG. 9 includes processing of eliminating a noise, processing of shaping a waveform, and the like.

The white streak detection processing unit 408 detects a white streak from a test image to identify a plurality of recording elements expected to include an abnormal recording element, or a rough position of the abnormal recording element. The white streak detection processing unit 408 corresponds to the white streak detection step S108 illustrated in FIG. 7, and the white streak detection step S208 illustrated in FIG. 8. In addition, the white streak detection processing unit 408 serves as a white streak detection device.

The stage identifying processing unit 410 identifies a stage with uniform intervals of the ruled line portions 502 from a test image. The stage identifying processing unit 410 corresponds to the stage identifying step S110 illustrated in FIG. 7, and the stage identifying step S210 illustrated in FIG. 8. In addition, the stage identifying processing unit 410 serves as a stage identifying device.

The abnormal recording element position identifying unit 412 identifies a position of an abnormal recording element from a result of identifying a stage, and may identify a kind of abnormality of the abnormal recording element according to presence or absence of a black streak. The abnormal recording element position identifying unit 412 is capable of identifying a direction of a position shift in recording of an abnormal recording element from a positional relationship between a white streak and a black streak as well as identifying an interval of the position shift in recording of the abnormal recording element from an interval between the white streak and the black streak.

The abnormal recording element position identifying unit 412 corresponds to the abnormal recording element position identifying step S112 illustrated in FIG. 7, and the abnormal recording element position identifying step S212 illustrated in FIG. 8. In addition, the abnormal recording element position identifying unit 412 serves as an abnormal recording element position identifying processing device, and the reading data processing unit 406, the white streak detection processing unit 408, the stage identifying processing unit 410, and the abnormal recording element position identifying unit 412, serve as an analysis unit for analyzing a test image as well as an analysis device for analyzing a test image.

The abnormal recording element position storage unit 414 stores an identified position of an abnormal recording element. The abnormal recording element position storage unit 414 corresponds to the abnormal recording element position storage step S114 illustrated in FIG. 7, and the abnormal recording element position storage step S214 illustrated in FIG. 8. In addition, the abnormal recording element position storage unit 414 serves as an abnormal recording element position storage device.

It is also possible to configure an abnormal recording element detection program in accordance with the abnormal recording element detection method illustrated in FIG. 8, and the abnormal recording element detection system 400 illustrated in FIG. 9, the program allowing a computer to serve as: a test image acquiring device corresponding to the test image acquiring unit 404; a reading data processing device corresponding to the reading data processing unit 406; a white streak detection processing device corresponding to the white streak detection processing unit 408; a stage identify processing device corresponding to the stage identifying processing unit 410; an abnormal recording element position identifying device corresponding to the abnormal recording element position identifying unit 412; and an abnormal recording element storage device corresponding to the abnormal recording element position storage unit 414. In addition, it is also possible to configure a storage medium that stores the abnormal recording element detection program.

FIG. 10 is an illustration of a reference profile. FIG. 11 is an illustration of a detection profile. The detection profile is created from reading data on a test image with an abnormal recording element. FIG. 12 is an illustration of a difference profile. Each of the profiles illustrated in FIGS. 10 to 12 shows a relationship between reading positions and reading signal values in reading data.

The stages of FIGS. 10 to 12 correspond to the respective stages of the test image 500 illustrated in FIG. 1 and the test image 510 illustrated in FIG. 2. A numeric value attached to a left edge of each of FIGS. 10 to 12 designates a stage number. The numeric value designating a stage number corresponds to a branch number attached to a reference numeral 508 illustrated in FIG. 1, and a branch number attached to a reference numeral 508A illustrated in FIG. 2. Horizontal axes of FIGS. 10 to 12 indicate positions of recording elements, and the left edge indicates a first recording element and a right edge indicates a hundredth recording element. A reading position in reading data corresponds to a position of a recording element.

Vertical axes of FIGS. 10 to 12 indicate reading signal values in reading data on a test image. The reading signal value is indicated as a positive value on a bright side and as a negative value on a dark side, with reference to a signal value of the portion between-ruled-lines 504. The reference signal value of the portion between-ruled-lines 504 is an average of a plurality of signal values included in the portion between-ruled-lines 504.

In each stage of the reference profile 520 illustrated in FIG. 10, a projecting portion designated by a reference numeral 522 corresponds to the ruled line portion 502 in the test image 500 of FIG. 1. In addition, a flat portion designated by a reference numeral 524 corresponds to the portion between-ruled-lines 504 in the test image 500 of FIG. 1.

In the reference profile of FIG. 10, intervals of the projecting portions 522 are uniform in every stage, so that lengths of the flat portions 524 between the projecting portions 522 are uniform.

In each stage of the detection profile 540 illustrated in FIG. 11, a projecting portion designated by a reference numeral 542 corresponds to the ruled line portion 502 in the test image 510 of FIG. 2. In addition, a flat portion designated by a reference numeral 544 corresponds to the portion between-ruled-lines 504 in the test image 510 of FIG. 2.

A projecting portion designated by a reference numeral 552 illustrated in FIG. 11 corresponds to the white streak 512 illustrated in FIG. 2, and a recessed portion designated by a reference numeral 554 illustrated in FIG. 11 corresponds to the black streak 514 illustrated in FIG. 2.

In the sixth stage in the detection profile 540 illustrated in FIG. 11, although there is the projecting portion 552 corresponding to the white streak 512 illustrated in FIG. 2, there is no projecting portion 542 that should exist within one interval between the projecting portion 552 and the projecting portion 542. In addition, in the tenth stage in the detection profile 540 illustrated in FIG. 11, there is no recessed portion 554 corresponding to the black streak 514 illustrated in FIG. 2.

In the difference profile 560 illustrated in FIG. 12, there are a projecting portion 562 and a recessed portion 564 in the first to fifth stages, and the seventh to tenth stages, other than the sixth stage, and there is no projecting portion 562 and recessed portion 564 in the sixth stage. The projecting portion 562 in the difference profile 560 corresponds to the white streak 512 in the test image 510 of FIG. 2, and the recessed portion 564 illustrated in FIG. 12 corresponds to the black streak 514 in the test image 510 of FIG. 2.

Meanwhile, in the sixth stage of the difference profile 560, there are no projecting portion 562 and recessed portion 564 that exist in other stages and is only a flat portion because there is no difference between the reference profile 520 of FIG. 10 and the detection profile 540 of FIG. 11, and thus the profiles are identical. The stage having only the flat portion corresponds to the sixth stage pattern 508A-6 from the top of FIG. 2 in which the ruled line portions 502 have uniform intervals.

Thus, it is possible to grasp that there is an abnormal recording element in accordance with an analysis result of the difference profile 560, if there are the projecting portion 562 and the recessed portion 564. It is also possible to identify a plurality of recording elements expected to include an abnormal recording element, which is a rough positon of the abnormal recording element, from a position of the projecting portion 562 of the difference profile 560. As a result, identifying a stage having only a flat portion, in which no difference between the reference profile 520 and the detection profile 540 is found, enables the abnormal recording element to be identified from among the plurality of recording elements expected to include the abnormal recording element in accordance with the reference profile 520 and the detection profile 540.

In addition, it is possible to grasp an amount of position shift from a required recording position in the abnormal recording element, from an interval between the projecting portion 562 and the recessed portion 564, as well as possible to grasp a direction of the position shift, from a positional relationship between the projecting portion 562 and the recessed portion 564.

In the present embodiment, although the reference profile 520 is subtracted from the detection profile 540 to calculate the difference profile 560, the detection profile 540 may be subtracted from the reference profile 520 to calculate a difference profile.

If the detection profile 540 is subtracted from the reference profile 520 to calculate a difference profile, a position corresponding to the white streak 512 illustrated in FIG. 2 is a recessed portion, and a position corresponding to the black streak 514 is a projecting portion.

The automatic detection of an abnormal recording element acquires information on an abnormal recording element, such as a position, a kind of abnormality, a direction of position shift, and an interval of position shift, the information being available for correction processing and the like in image recording using a recording head.

The test image, the test image forming system, the test image forming method, the test image forming program, the storage medium, the abnormal recording element detection system, the abnormal recording element detection method, the abnormal recording element detection program, and the recording medium, configured as described above, enable abnormal recording element detection by using a test image that realizes a case where recording characteristics of the first recording element depend on recording conditions of the second recording element arranged in a periphery of the first recording element, and where the first recording element has relatively low independent recording characteristics. Performing the abnormal recording element detection using the test image in accordance with the present invention enables an abnormal recording element, which may be problem in recording of a practical image, to be reliably detected.

Analyzing a test image enables a position and a kind of abnormality of an abnormal recording element to be identified. As a result, it is possible to take appropriate measures, such as correction processing at the time of recording a practical image, for an abnormal recording element.

(Description of Another Example of Creation of Reference Profile)

It is possible to create the reference profile 520 illustrated in FIG. 10 from reading data of the test image 500 illustrated in FIG. 1. That is, it is possible to create a reference profile from reading data of the test image 500 recorded by using a recording head with no abnormal recording element. A state of the recording head with no abnormal recording element is reflected to the reference profile 520.

Unfortunately, if there is an abnormal recording element in an initial state of the recording head, it is impossible to create the test image 500 illustrated in FIG. 1, and thus it is impossible to create the reference profile 520 illustrated in FIG. 10.

Thus, a method of virtually creating the reference profile 520 by using a detection profile created from reading data on the test image 540 recorded by using a recording head with an abnormal recording element will be described below. Since the test image 500 illustrated in FIG. 1 has ruled line portions 502 and portions between-ruled-lines 504 that are regularly arranged, portions recorded by a normal recording element are extracted from the detection profile 540 created from reading data on the test image 510 illustrated in FIG. 2 to be copied in consideration of periodicity of the reference profile, and then the copied portions are joined to each other to enable the reference profile 520 to be virtually created.

It is also possible to create reading data on the test image 500 illustrated in FIG. 1 by using a technique of software to virtually create the reference profile 520. It is preferable that the abnormal recording element detection system 400 illustrated in FIG. 9 includes a reference profile storage unit that stores the reference profile 520 illustrated in FIG. 10.

The abnormal recording element detection system 400 illustrated in FIG. 9 may include a reference profile creating unit that creates the reference profile 520 illustrated in FIG. 10. It is possible to configure an abnormal recording element detection method including the step of storing a reference profile, and an abnormal recording element detection program that allows a computer to serve as a reference profile storage device, by corresponding to the reference profile storage unit.

Likewise, it is possible to configure an abnormal recording element detection method including the step of creating a reference profile, and an abnormal recording element detection program that allows a computer to serve as a reference profile creating device, by corresponding to the reference profile creating unit.

(Relationship with Measurement Noise)

If a recording head is in a perfect state with a minute variation of an amount of record and no error in a recording position except existence of an abnormal recording element as well as a system for reading out a test image is in a perfect state with no minute variation of readout and sufficient reading definition for recording definition of the recording head, it is possible to accurately find a position of the projecting portion 562 in the difference profile 560 of FIG. 12. As a result, only information of the position of the projecting portion 562 ought to enable a position of the abnormal recording element or an abnormal recording element number to be identified.

However, there is actually no such a perfect system. That is, there is no perfect flatness like the sixth state of the difference profile 560 of FIG. 12. Thus, a method of detecting a stage with a minimum peak value in a difference profile as well as analyzing the stage to accurately detect a position of an abnormal recording element is effective.

In addition, quantization processing or differential processing may be applied to the difference profile 560 of FIG. 12 so that the projecting portion 562 and the recessed portion 564 are extracted to identify a stage without the projecting portion 562 and the recessed portion 564.

(Another Example of Identifying Position of Abnormal Recording Element)

Figure 13:
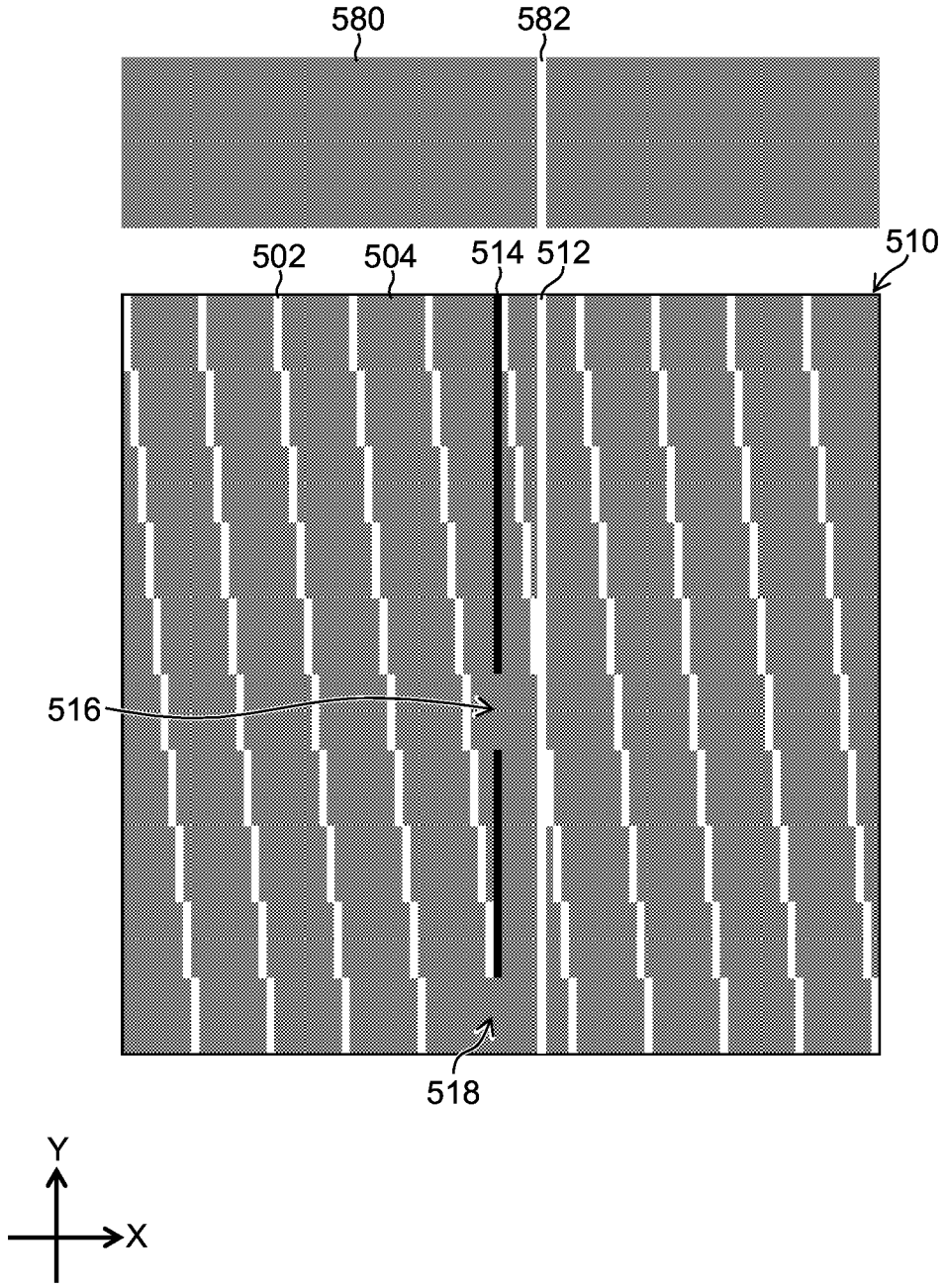
FIG. 13 is an illustration of another example of a configuration to identify a position of an abnormal recording element.

FIG. 13 is an illustration of another example of a configuration to identify a position of an abnormal recording element. In the description below, a configuration that is the same as the configuration described before is designated by the same reference numeral so that a description thereof is appropriately omitted.

A configuration of identifying a position of an abnormal recording element illustrated in FIG. 13 allows a uniform density portion 580 with uniform third density corresponding to the third input gradation value to be formed in recording areas of the first recording element and the second recording element in the first direction X, separated from the test image 510 illustrated in FIG. 2, to identify a position of an abnormal recording element in combination with the uniform density portion 580.

Since an actual difference profile 560 is affected by various noises, there is a possibility that detection of the projecting portion 562 and the recessed portion 564 of the difference profile 560 illustrated in FIG. 12 may become unstable. The recording area of the first recording element is a general term of a recording area of each of the first recording elements.

The uniform density portion 580 illustrated in FIG. 13 is used to identify a position of a white streak 582 of the uniform density portion 580 to identify a plurality of recording elements expected to include an abnormal recording element, or a rough position of the abnormal recording element.

Since the uniform density portion 580 has no ruled line portion 502 that tends to cause noise, detection of the white streak 582 has good robustness.

Any density value is applicable to the third density value of the uniform density portion 580, corresponding to the third input gradation value, if the white streak 582 is detectable. For example, the second input gradation value corresponding to the second density value, which is the same as that for the portion between-ruled-lines 504, is applicable as the third input gradation value.

As an example of detection of a position of the white streak 582, a difference between a scan profile of the uniform density portion 580 and a profile obtained by applying smoothing processing to a profile that is the same as the scan profile of the uniform density portion 580 is analyzed or observed so that a position where a difference between both the profiles is large may be detected. In consideration of an object that is not to detect the black streak 514 illustrated in FIG. 2, but to detect the white streak 582 illustrated in FIG. 13, a reference numeral of a difference needs to be taken care of.

The uniform density portion 580 may be recorded on a recording medium on which the test image 510 is recorded, or recorded on a recording medium other than the recording medium on which the test image 510 is recorded.

(Example of Identification of Position of Abnormal Recording Element Using Practical Image)

FIG. 14 is an illustration of identification of a position of an abnormal recording element by using a practical image. Reading data on a practical image or the practical image is used to detect a white streak or a black streak to enable a rough position of an abnormal recording element to be identified. That is, reading data on a practical image 600 illustrated in FIG. 14, or the practical image 600 is acquired so that the uniform density area 610 corresponding to the uniform density portion 580 illustrated in FIG. 13 is extracted from input data on the practical image 600. Then, input data on the uniform density area 610 extracted and reading data on the uniform density area 610 are compared with each other to detect a white streak. As a result, a position of the white streak and a peripheral position of the white streak are identified as a plurality of recording elements expected to include an abnormal recording element, or a rough position of the abnormal recording element.

The practical image 600 is used to identify a plurality of recording elements expected to include an abnormal recording element, or a rough position of the abnormal recording element enable a white streak under actual recording conditions to be detected. It is unnecessary to use the uniform density portion 580 illustrated in FIG. 13.

In a case where the practical image 600 is used, white streak detection is previously performed at the time of recording the practical image 600. Then a result of the white streak detection is stored to be available in abnormal recording element detection during recording of a practical image having the same content as that of the practical image 600.

(Measures for Interference of Deposits)

Figure 15A:
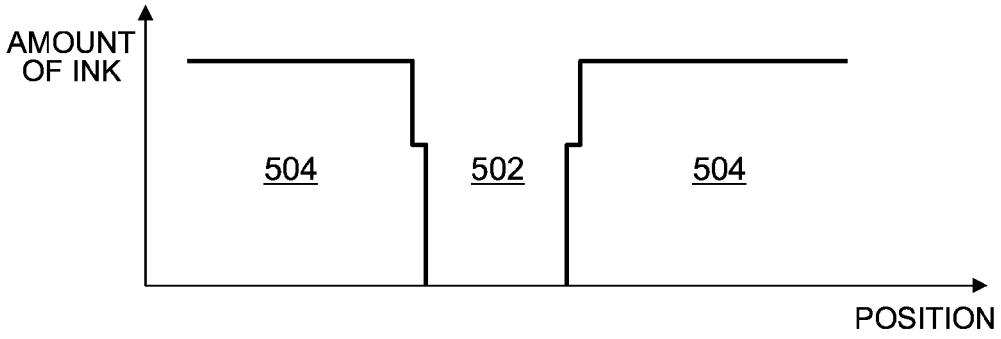
FIG. 15A is an illustration of an example of a test image in consideration of interference of deposits.
Figure 15B:
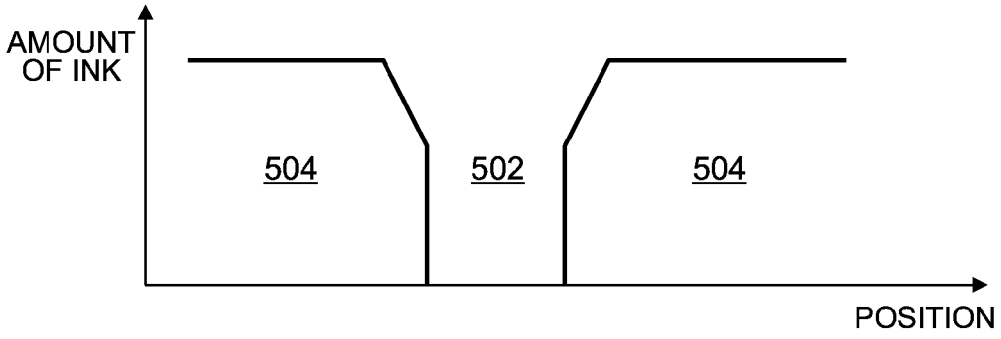
FIG. 15B is an illustration of another example of the test image in consideration of interference of deposits.
Figure 16:
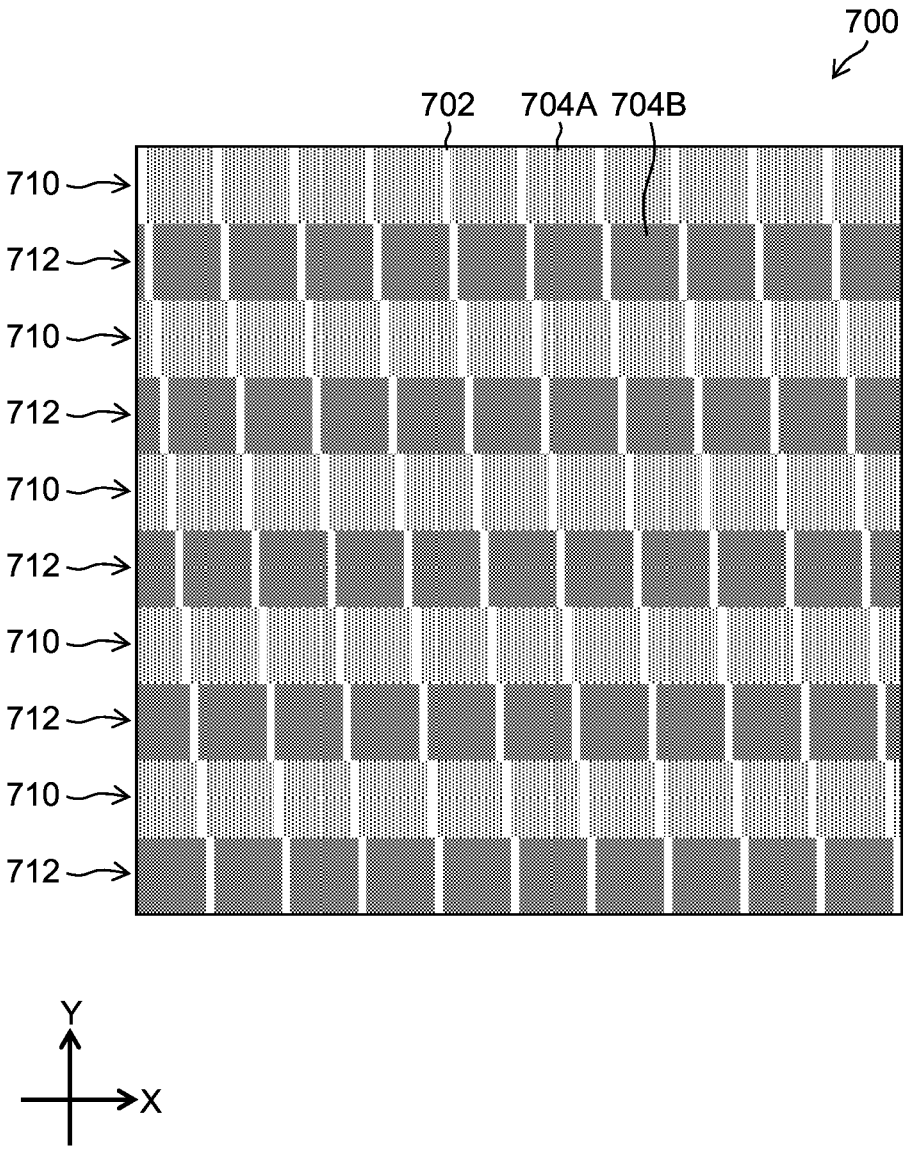
FIG. 16 is an illustration of another example of the test image in consideration of interference of deposits.

FIG. 15A is an illustration of an example of a test image in consideration of interference of deposits. FIG. 15B is an illustration of another example of the test image in consideration of interference of deposits. FIG. 16 is an illustration of another example of the test image in consideration of interference of deposits. In the description below, a recording element is described as a nozzle.

An image recorder of an ink jet method is required to form a test image in consideration of interference of deposits. The interference of deposits is a phenomenon in which, if there is an existing ink dot, which has already been deposited, in a periphery of a deposit position of an ink dot that is newly deposited when an ink dot is deposited on a recording medium, the existing ink dot and the newly deposited ink dot attract each other, or repel each other, to cause a position shift of a deposit.

A 1-on-N-off test image allows an interval between ruled lines to be sufficient to hardly cause interference of deposits, whereby interference of deposits may not be problem. Meanwhile, a test image in accordance with the present embodiment may cause ink dots constituting portions between-ruled-lines 504 adjacent to opposite edges across the ruled line portion 502 to interfere with each other and to be mixed with each other, thereby reducing the ruled line portion 502 in width or eliminating the ruled line portion 502, depending on extent of interference of deposits.

In a case where dots are recorded in the ruled line portion 502, interference of deposits may occur between dots of the ruled line portion 502 and dots at a recording position at an edge of the portion between-ruled-lines 504 to reduce the ruled line portion 502 in width or eliminate the ruled line portion 502.

It is effective to reduce an amount of ink in the portion between-ruled-lines 504 with respect to a standard amount of ink to prevent reduction in width of the ruled line portion 502 or elimination of the ruled line portion 502 caused by interference of deposits of ink dots constituting the portion between-ruled-lines 504. The standard amount of ink is an amount of ink at a recording position to which no processing of reducing an amount of ink is applied.

To reduce the amount of ink in the portion between-ruled-lines 504 with respect to the standard amount of ink, an input gradation value at a recording position at which the amount of ink is reduced should be reduced in accordance with reduction in the amount of ink. In addition, data after the amount of ink is determined may be processed. Measures for interference of deposits is feasible by allowing the correction processing unit 308 of the test image forming system 300 illustrated in FIG. 6 to be provided with an input gradation value adjustment function or an amount-of-ink adjusting processing function to serve as an input gradation value adjustment unit or an amount-of-ink adjusting processing unit.

In the test image forming method illustrated in FIG. 5, applying adjusting processing to the input gradation value in the correction processing step S14, or performing amount-of-ink adjusting processing step between the halftone processing step S16 and the test image forming step S18, also enables the measures for interference of deposits to be achieved.

Each of FIGS. 15A and 15B schematically illustrates an amount of ink of the ruled line portion 502 and an amount of ink of the portion between-ruled-lines 504 in the test image 500 illustrated in FIG. 1, or the test image 510 illustrated in FIG. 2. The amount of ink in FIGS. 15A and 15B is replaceable with an input gradation value.

FIG. 15A illustrates an example in which an amount of ink of recording positions at respective edges of the portion between-ruled-lines 504 is reduced half an amount of ink determined in accordance with an input gradation value. The recording position at the edge of the portion between-ruled-lines 504 is in a boundary between the portion between-ruled-lines 504 and the ruled line portion 502.

FIG. 15B illustrates an example in which an amount of ink at a plurality of recording positions from the recording position at the edge of the portion between-ruled-lines 504 is reduced with respect to a standard amount of ink. In the example illustrated in FIG. 15B, the amount of ink is continuously reduced in the plurality of recording positions from the recording position at the edge of the portion between-ruled-lines 504. The amount of ink may be reduced stepwise.

If the amount of ink in the portion between-ruled-lines 504 is reduced, density in the portion between-ruled-lines 504 decreases to reduce contrast between the ruled line portion 502 and the portion between-ruled-lines 504. Reducing the contrast between the ruled line portion 502 and the portion between-ruled-lines 504 causes an image recorder for forming a test image and a scanner for reading out a test image to deteriorate their robustness with respect to noise.

Thus, it is preferable to adjust an amount of ink in the recording position at the edge of the portion between-ruled-lines 504, or an amount of ink in a plurality of recording positions from the recording position at the edge of the portion between-ruled-lines 504, to the extent that the ruled line portion 502 sandwiched by two portions between-ruled-lines 504 is not eliminated even if droplets of ink deposited at the edges of the portion between-ruled-lines 504 at respective sides of the ruled line portion 502 are brought into contact with each other due to occurrence of interference of the deposits, as well as to the extent that the robustness with respect to noise in the image recorder and the scanner is not deteriorated.

FIG. 16 is an illustration of another example of the test image in consideration of interference of deposits. FIG. 16 illustrates a test image 700 in which nozzles causing similar extent of interference of deposits or a state of the interference of deposits are used in the same state by adjusting intervals of ruled line portions 702.

In accordance with extent of interference of deposits or a state of the interference of deposits of nozzles used in recording for each of stages, an amount of ink of the portion between-ruled-lines 504 each of the stages, particularly an amount of ink at the edge of the portion between-ruled-lines 504 of each of the stages, is adjusted.

In the test image 700 illustrated in FIG. 16, an amount of ink of a portion between-ruled-lines 704A in each of odd-numbered stages 710 is less than an amount of ink of a portion between-ruled-lines 704B in each of even-numbered stages 712. The amount of ink of both the portions is determined in consideration of detection performance of a white streak.

Although FIG. 16 illustrates an aspect in which an amount of ink is changed between the odd-numbered stage 710 and the even-numbered stage 712, for example, if there are three kinds of extent of interference of deposits, and the like, the odd-numbered stage 710 may be further finely divided, or the even-numbered stage 712 may be further finely divided.

That is, it is possible to take measures for interference of deposits, in which recording elements that cause a similar state of interference of deposits, such as extent of interference of deposits, and a kind thereof, are previously found out to set recording positions of the respective recording elements that cause the similar state of interference of deposits in the same stage by adjusting the number N of intervals of the first recording elements.

As described above, a test image is formed in consideration of interference of deposits to enable the ruled line portion 702 to be prevented from decreasing in width or being eliminated.

(Density of Ruled Line Portion)

Although the present embodiment allows input gradation values of the ruled line portion 502 and 702 to be set at zero, or allows recording elements for recording the ruled line portions 502 and 702 to be non-recording, density allowing the ruled line portion 502 and the portion between-ruled-lines 504 to be distinguished, and an input gradation value corresponding to the density, may be applied as density of the ruled line portion 502.

Thus, if there is no deterioration of accuracy, reliability, and the like of abnormal recording element detection, any value may be determined as the first input gradation value that is an input gradation value at the time of recording the ruled line portion 502.

In addition, any one of an aspect of continuously moving the first recording element in the second direction Y and an aspect of intermittently moving the first recording element in the second direction Y may be applied as an aspect of acquiring a density value corresponding to the first input gradation value to which an intermediate gradation value other than minimum and maximum gradation values is applied.

(Density of Portion Between-Ruled-Lines)

Although the present embodiment shows an example of the portions between-ruled-lines 504 that have uniform density, or have the same second input gradation value, except the aspects illustrated in FIGS. 15A, 15B, and 16, the second input gradation value may be changed for the portion between-ruled-lines 504 different in the same stage. In addition, one portion between-ruled-lines 504 may be recorded by using a plurality of second input gradation values.

Thus, if there is no deterioration of accuracy, reliability, and the like of abnormal recording element detection, any value may be determined as the second input gradation value that is an input gradation value at the time of recording the portion between-ruled-lines 504.

In addition, any one of an aspect of continuously moving the second recording element in the second direction Y and an aspect of intermittently moving the second recording element in the second direction Y may be applied as an aspect of acquiring a density value corresponding to the second input gradation value to which an intermediate gradation value other than minimum and maximum gradation values is applied. In addition, density may be distributed in the first direction X.

Although the present embodiment describes a case where there is one abnormal recording element, if there is a plurality of abnormal recording elements, positions of respective abnormal recording elements, and kinds thereof may be identified by using the same method.

By using the following described above, the test image, the test image forming system, the test image forming method, the test image forming program, the storage medium, the abnormal recording element detection system, the abnormal recording element detection method, the abnormal recording element detection program, and the storage medium, an abnormal recording element in an initial state of a recording head is detected so that information on the abnormal recording element such as a position of the abnormal recording element is stored in association with the recording head, thereby enabling detection of an abnormal recording element in an initial state of the recording head after mounted in a recorder to be omitted.

Providing the abnormal recording element detection method, the abnormal recording element detection system, or the abnormal recording element detection program, in an image recorder provided with the recording head enables an abnormal recording element to be detected during operation of the recording head, and the like. As a result, it is possible to take appropriate measures such as correction processing for an abnormal recording element generated by the operation of the recording head.

(Application Example to Apparatus)

Next, an image recorder of an ink jet method will be described as an application example of the following to an apparatus: the test image; the test image forming system; the test image forming method; the test image forming program; the storage medium; the abnormal recording element detection system; the abnormal recording element detection method; the abnormal recording element detection program; and the storage medium, in accordance with the present embodiment.

(Overall Structure)

Figure 17:
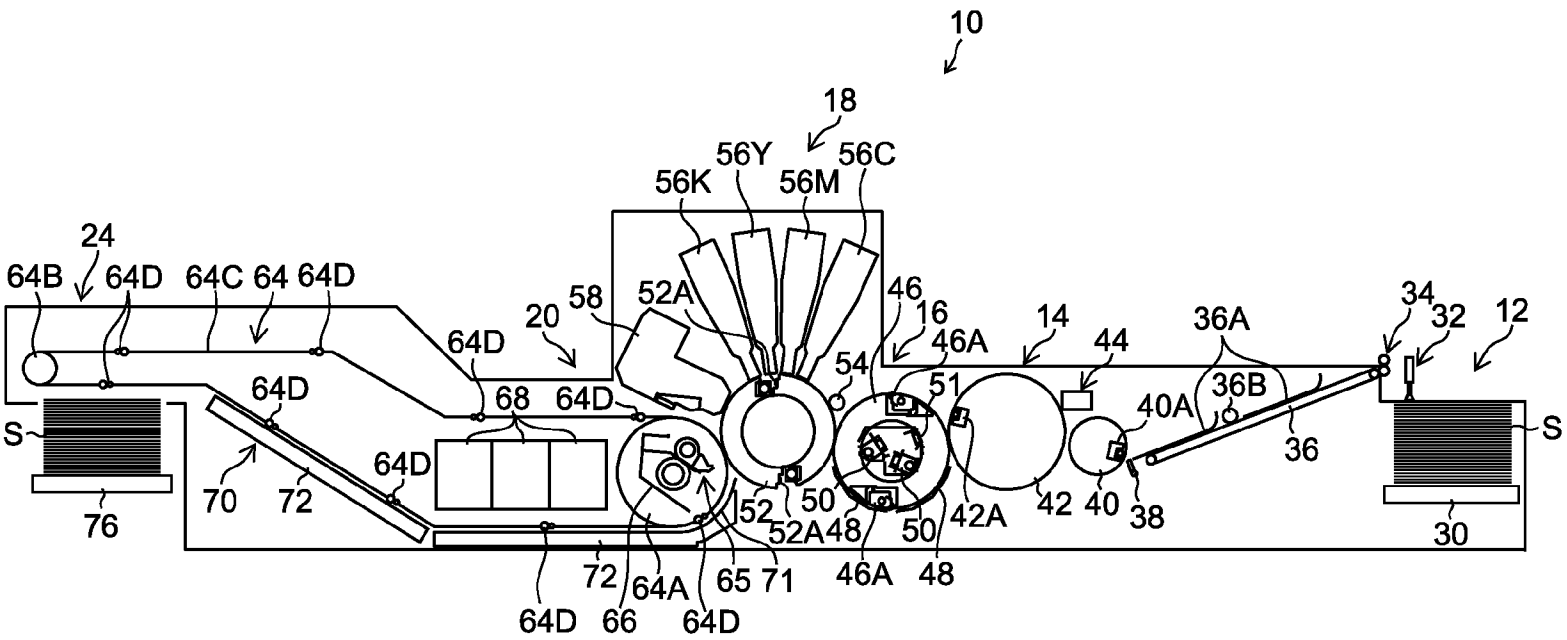
FIG. 17 is a general structural view of an ink jet recorder.

FIG. 17 is a general structural view of an ink jet recorder 10.

The ink jet recorder 10 illustrated in FIG. 17 is an image recorder of an ink-jet method in which an image is recorded on cut-sheet paper S by using ink by the ink jet method. The terms of "nozzle" and "nozzle portion" in the description below maybe read as "recording element".

The ink jet recorder 10 mainly includes: a paper feeding unit 12 that feeds the cut-sheet paper S; a treatment liquid applying unit 14 that applies treatment liquid to the cut-sheet paper S fed from the paper feeding unit 12; a treatment liquid drying processing unit 16 that applies drying processing to the cut-sheet paper S to which the treatment liquid is applied by the treatment liquid applying unit 14; a drawing unit 18 that records an image on the cut-sheet paper S to which the drying processing is applied by the treatment liquid drying processing unit 16 by using ink by the ink jet method; an ink drying processing unit 20 that applies drying processing to the cut-sheet paper S on which the image is recorded by the drawing unit 18; and a paper ejection unit 24 that ejects the cut-sheet paper S to which the drying processing is applied by the ink drying processing unit 20. In the present description, the terms of "drawing" and "printing" may be read as "image recording" and "image forming", or "recording" and "forming", respectively.

The ink drying processing unit 20 serves as a temperature adjustment unit that adjusts temperature of an object of temperature adjustment at a temperature more than ambient temperature of discharge faces of recording heads 56C, 56M, 56Y, and 56K. The ambient temperature of discharge faces is within a range of temperatures that cause condensation on the discharge faces.

(Paper Feeding Unit)

The paper feeding unit 12 mainly includes: a paper feeding base 30: a sucker device 32; a pair of paper feeding rollers 34; a feeder board 36; a front stopper 38; and a paper feeding barrel 40, to feed the cut-sheet paper S loaded on the paper feeding base 30 one by one to the treatment liquid applying unit 14.

The cut-sheet paper S loaded on the paper feeding base 30 is pulled up one by one from top to bottom by the sucker device 32 to be fed to the pair of paper feeding rollers 34. The cut-sheet paper S fed to the pair of paper feeding rollers 34 is mounted on the feeder board 36 to be transported by the feeder board 36.

The cut-sheet paper S is pressed on a transportation face of the feeder board 36 by a retainer 36A and a guide roller 36B so that its unevenness is corrected. A leading end of the cut-sheet paper S is brought into contact with the front stopper 38, so that an inclination of the cut-sheet paper S is corrected. The cut-sheet paper S transported by the feeder board 36 is delivered to the paper feeding barrel 40.

The cut-sheet paper S delivered to the paper feeding barrel 40 is transported to the treatment liquid applying unit 14 while its leading end is held by a gripper 40A of the paper feeding barrel 40. A detailed illustration of the gripper 40A is omitted.

The gripper 40A includes: a plurality of claws that are arranged along an axial direction of the paper feeding barrel 40; claw bases arranged at respective positions facing the plurality of claws; and gripper shafts that supports the respective claws in a swingable manner The gripper 40A is opened and closed by turning the gripper shafts to swing the respective claws. Arrangement of the plurality of claws is determined in accordance with size of the cut-sheet paper S.

(Treatment Liquid Applying Unit)

The treatment liquid applying unit 14 mainly includes: a treatment liquid barrel 42 that transports the cut-sheet paper S; and a treatment liquid applying device 44 that applies predetermined treatment liquid to an image recording face of the cut-sheet paper S transported by the treatment liquid barrel 42, to apply the treatment liquid to the image recording face of the cut-sheet paper S.

The treatment liquid applied to the cut-sheet paper S has a function of flocculating a color material in ink to be discharged on the cut-sheet paper S in the drawing unit 18 in a subsequent stage, or a function of insolubilizing the color material in the ink Discharging the ink after the treatment liquid is applied to the cut-sheet paper S enables high quality printing to be performed without interference of deposits even if general-purpose paper sheet is used.

The terms of "discharge", "deposit", "recording", and "forming", in the present description, may be replaced with each other.

The cut-sheet paper S delivered from the paper feeding barrel 40 of the paper feeding unit 12 is delivered to the treatment liquid barrel 42. The treatment liquid barrel 42 holds the leading end of the cut-sheet paper S with a gripper 42A to hold the paper sheet on its outer peripheral surface by absorptive holding.

A description of the gripper 42A is omitted because the same structure as that of the gripper 40A provided in the paper feeding barrel 40 is applicable.

The treatment liquid barrel 42 is turned while the leading end to the cut-sheet paper S is held by the gripper 42A and the cut-sheet paper S is held on the outer peripheral surface of the treatment liquid barrel 42, so that the cut-sheet paper S is wound around the outer peripheral surface of the treatment liquid barrel 42 to be transported. The treatment liquid applying device 44 applies the treatment liquid to the cut-sheet paper S to be transported to the treatment liquid barrel 42.

The application form includes coating by using a coating roller, coating by using a blade, and the like, for example. Another application form includes discharge by an ink jet method, spray by a spray method, and the like, for example.

(Treatment Liquid Drying Processing Unit)

The treatment liquid drying processing unit 16 mainly includes: a treatment liquid drying processing barrel 46 that transports the cut-sheet paper S; a paper sheet transportation guide 48 that supports the cut-sheet paper S to be transported by the treatment liquid drying processing barrel 46; and a treatment liquid drying processing unit 50 that blows hot air to the cut-sheet paper S to be transported by the treatment liquid drying processing barrel 46 to dry the cut-sheet paper S, to apply drying processing to cut-sheet paper S to which the treatment liquid is applied.

The treatment liquid drying processing barrel 46 is provided in its inside with a treatment liquid drying barrel blower 51 that sends air to a delivery position of the cut-sheet paper S to be delivered from the treatment liquid barrel 42 to the treatment liquid drying processing barrel 46.

The leading end of the cut-sheet paper S delivered from the treatment liquid barrel 42 to the treatment liquid drying processing barrel 46 of the treatment liquid applying unit 14 is held by a gripper 46A provided in the treatment liquid drying processing barrel 46. A description of the gripper 46A is omitted because the same structure as that of the gripper 40A provided in the paper feeding barrel 40 is applicable.

The paper sheet transportation guide 48 supports a face opposite to a face coated with the treatment liquid of the cut-sheet paper S while the face coated with the treatment liquid faces inward. The treatment liquid drying processing barrel 46 is turned to wind the cut-sheet paper S around an outer peripheral surface of the treatment liquid drying processing barrel 46 to transport the cut-sheet paper S.

The treatment liquid drying processing unit 50 provided inside the treatment liquid drying processing barrel 46 blows hot air to the cut-sheet paper S to be transported by the treatment liquid drying processing barrel 46, thereby applying drying processing to the cut-sheet paper S. When the drying processing is applied to the cut-sheet paper S, a solvent component in the treatment liquid applied to the cut-sheet paper S is removed to form a treatment liquid layer in the face of the cut-sheet paper S, to which the treatment liquid is applied.

(Image Recording Unit)

The drawing unit 18 mainly includes: a drawing barrel 52 that serves as a pressing barrel for turning and transporting the cut-sheet paper S; a paper sheet pressing roller 54 that presses the cut-sheet paper S to be transported by the drawing barrel 52 so that the cut-sheet paper S is brought into close contact with an outer peripheral surface of the drawing barrel 52; recording heads 56C, 56M, 56Y, and 56K of an ink jet method that discharge ink droplets of colors C, M, Y, and K on the cut-sheet paper S, respectively; and an in-line sensor 58 that reads out an image drawing on the cut-sheet paper S, to discharge ink droplets of respective colors C, M, Y, and K to the cut-sheet paper S, on which the treatment liquid layer is formed, to draw a color image on the cut-sheet paper S.

In the description below, the recording head of an ink jet method will be sometimes described as a recording head. The recording heads 56C, 56M, 56Y, and 56K, illustrated in FIG. 17, serve as a part of the test image forming unit 312 illustrated in FIG. 6.

Various methods, such as a piezoelectric method of discharging ink by using flexural deformation of a piezoelectric element, and a thermal method of heating ink to allow a film boiling phenomenon to occur to discharge ink, are applicable to the recording heads 56C, 56M, 56Y, and 56K, applied to the present example.

Figure 19:
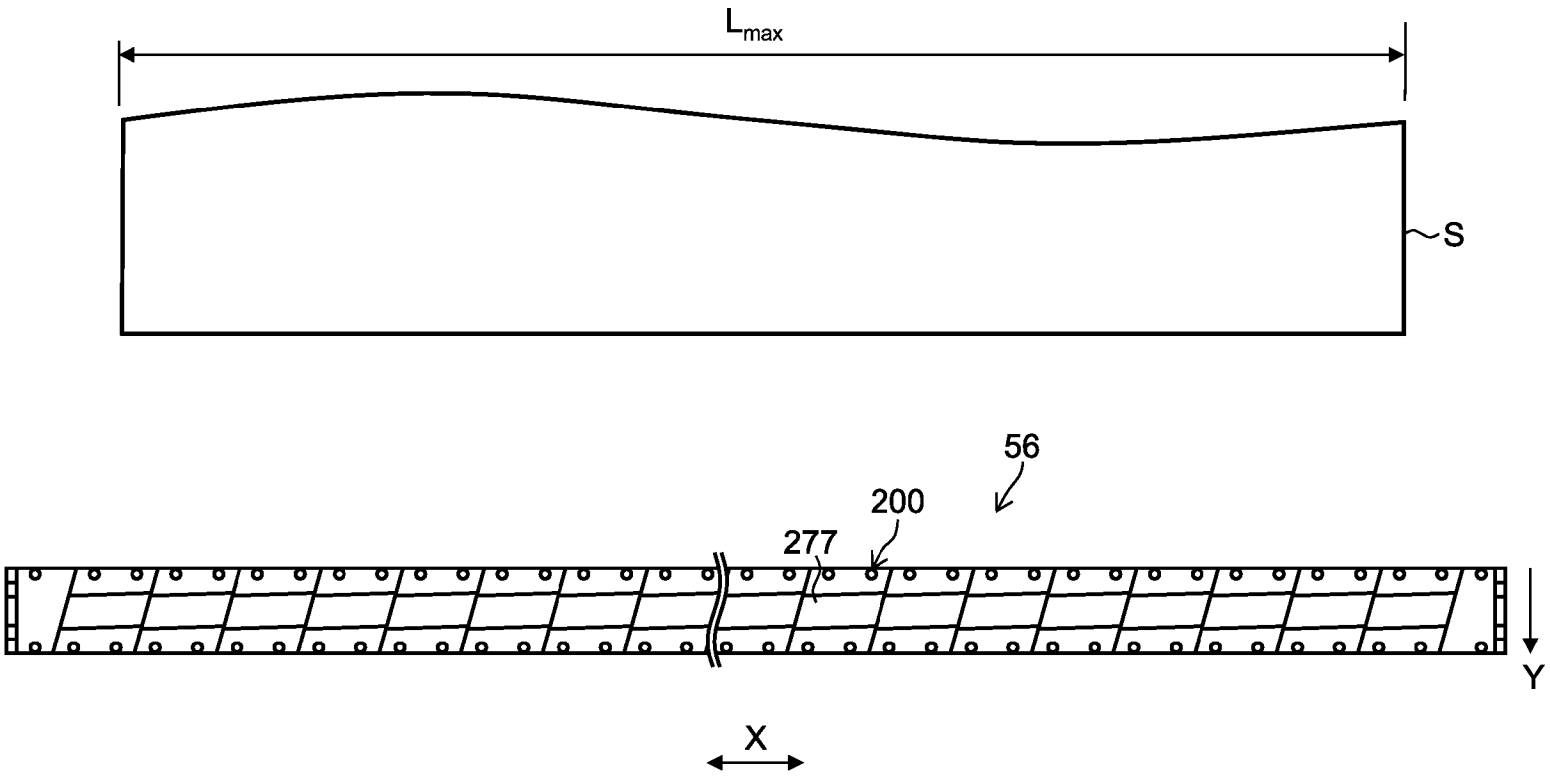
FIG. 19 is a structural view of the recording head illustrated in FIG. 17, and is a perspective plan view of a discharge face of discharging droplets of ink.

The recording heads 56C, 56M, 56Y, and 56K, applied to the present example, are applied to a full-line type head designated by a reference numeral 56 illustrated in FIG. 19. Details of the full-line type head will be described later.

The leading end of the cut-sheet paper S delivered from the treatment liquid drying processing barrel 46 of the treatment liquid drying processing unit 16 to the drawing barrel 52 by a gripper 52A provided in the drawing barrel 52 holds. A description of the gripper 52A is omitted because the same structure as that of the gripper 42A provided in the paper feeding barrel 42 is applicable.

The cut-sheet paper S is passed through below the paper sheet pressing roller 54 to be brought into close contact with the outer peripheral surface of the drawing barrel 52.

When the cut-sheet paper S that is held on the outer peripheral surface of the drawing barrel 52 by absorptive holding and is transported passes through an ink discharge area immediately below the recording heads 56C, 56M, 56Y, and 56K, the recording heads 56C, 56M, 56Y, and 56K, discharge ink droplets of the colors C, M, Y, and K, respectively, to record a color image.

The ink attached to the cut-sheet paper S reacts with the treatment liquid layer formed in the cut-sheet paper S to be fixed on the cut-sheet paper S without causing feathering, bleeding, and the like. In this way, a high quality image is drawn on the cut-sheet paper S.

When the cut-sheet paper S on which an image is drawn by the recording head 56C, 56M, 56Y, and 56K, passes through a reading area of the in-line sensor 58, the image drawn is read out. The image read out by the in-line sensor 58 includes a test image.

The in-line sensor 58 includes an imaging element, such as a CCD image sensor, and is applied to an imaging apparatus that creates electrical image data on an image of a reading object. The CCD is an abbreviation of a charge coupled device.

The in-line sensor 58 reads out an image if necessary, and recording element abnormality detection of the recording heads 56C, 56M, 56Y, and 56K is performed in accordance with reading data on the image.

That is, a test image, such as the test image 500 illustrated in FIG. 1, and the test image 510 illustrated in FIG. 2, is formed by using the recording heads 56C, 56M, 56Y, and 56K, and the test image is read out by using the in-line sensor 58 illustrated in FIG. 17.

If a test image, such as the test image 510 illustrated in FIG. 2 in which an abnormal recording element exists, is acquired, analyzing reading data of the in-line sensor 58 enables a position of the abnormal recording element, a kind of abnormality of the abnormal recording element, and the like to be grasped.

Using the in-line sensor 58 enables an abnormal recording element that occurs during operation of the recorder to be detected. As a result, it is possible to take measures, such as correction processing with respect to the abnormal recording element, at the time when abnormality is detected.

After the cut-sheet paper S passes through the reading area of the in-line sensor 58, absorption of the cut-sheet paper S by the drawing barrel 52 is released, and then the cut-sheet paper S is delivered to the ink drying processing unit 20.

(Ink Drying Processing Unit)

The ink drying processing unit 20 includes an ink drying processing unit 68 that applies drying processing to the cut-sheet paper S transported by a chain gripper 64 to apply the drying processing to the cut-sheet paper S after drawing to remove a liquid component remaining in the cut-sheet paper S.

A structural example of the ink drying processing unit 68 includes a heat source such as a halogen heater and an infrared ray heater, and a fan that blows air heated by the heat source to the cut-sheet paper S. The ink drying processing unit 68 serves as a temperature adjustment unit that adjusts temperature of the cut-sheet paper S after drawing that is an object of temperature adjustment at a temperature more than ambient temperature of the recording heads 56C, 56M, 56Y, and 56K.

The leading end of the cut-sheet paper S delivered from the drawing barrel 52 of the drawing unit 18 to the chain gripper 64 is held by grippers 64D provided in the chain gripper 64, and the cut-sheet paper S is transported to a support area of a transportation guide 71.

The chain gripper 64 has a structure in which a pair of endless chains 64C is stretched between a first sprocket 64A and a second sprocket 64B. The gripper 64D has a structure in which a plurality of claws is arranged between the pair of chains 64C, and a claw base is arranged at a position facing the claw.

The plurality of claws is supported by a gripper shaft whose opposite ends are supported by the pair of chains 64C in a swingable manner. The gripper 64D is opened and closed by turning the gripper shaft to swing the plurality of claws.

The ink drying processing unit 68 serves as a temperature adjustment unit, or a drying processing unit, and is arranged at a position where temperature adjustment is performed for the cut-sheet paper S transported by the chain gripper 64 serves as a second transportation unit.

The transportation guide 71 guides a trailing end portion of the cut-sheet paper S transported by the chain gripper 64, and the rear end portion is absorbed by guide plates 72 arranged between the chain grippers 64 at predetermined intervals to prevent the trailing end of the cut-sheet paper S from rising.

(Paper Ejection Unit)

The paper ejection unit 24 retrieves the cut-sheet paper S after a series of image recording is performed, and includes an ejected paper base 76 on which the cut-sheet paper S retrieved is stacked.

The chain gripper 64 releases the cut-sheet paper S over the ejected paper base 76 to stack the cut-sheet paper S on the ejected paper base 76. The ejected paper base 76 allows the cut-sheet paper S released from the chain gripper 64 to be stacked thereon to retrieve the cut-sheet paper S.

The paper ejection unit 24 includes an ejected paper base lifting device that moves the ejected paper base 76 up and down. The ejected paper base lifting device is not illustrated. The ejected paper base lifting device is controlled so as to be driven in conjunction with the number of the cut-sheet paper S stacked on the ejected paper base 76. As a result, the ejected paper base 76 is moved up and down so that the top of the stacked cut-sheet paper S is always positioned at a predetermined height.

(Description of Control System)

Figure 18:
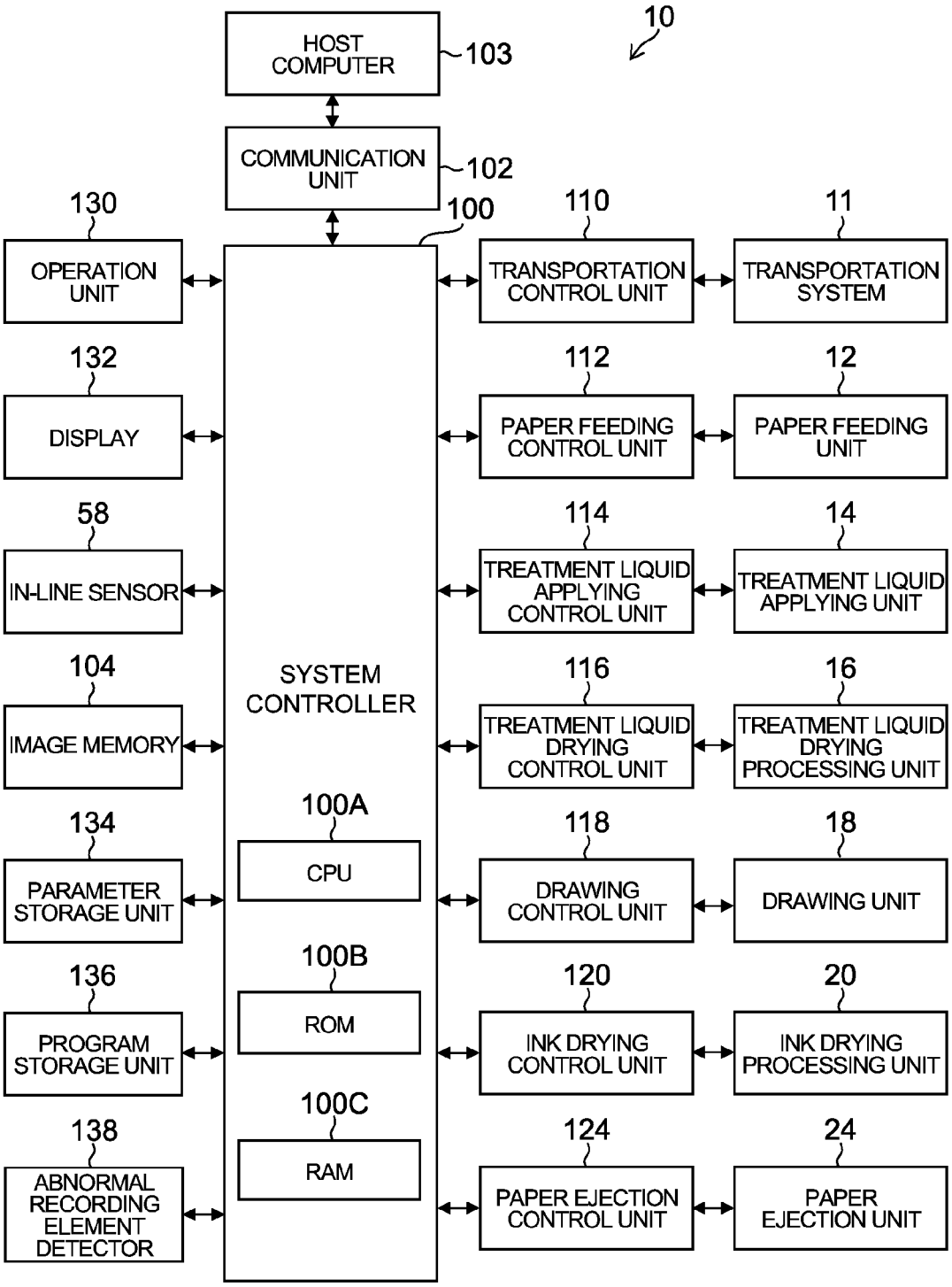
FIG. 18 is a block diagram illustrating a schematic configuration of a control system of the ink jet recorder illustrated in FIG. 17.

FIG. 18 is a block diagram illustrating a schematic configuration of a control system of the ink jet recorder 10 illustrated in FIG. 17.

As illustrated in FIG. 18, the ink jet recorder 10 includes a system controller 100, a communication unit 102, an image memory 104, a transportation control unit 110, a paper feeding control unit 112, a treatment liquid applying control unit 114, a treatment liquid drying control unit 116, a drawing control unit 118, an ink drying control unit 120, a paper ejection control unit 124, an operation unit 130, a display 132, and the like.

The system controller 100 serves not only as an overall control unit that integrally controls each unit of the ink jet recorder 10 but also as a calculation unit that performs various arithmetic processing operations. The system controller 100 includes a CPU 100A, a ROM 100B, and a RAM 100C. The CPU is an abbreviation of a central processing unit, and the ROM is an abbreviation of a read only memory. The RAM is an abbreviation of a random access memory.

The system controller 100 also serves a memory controller for controlling writing of data to memories, such as the ROM 100B, the RAM 100C, and the image memory 104, and reading out of data from the memories.

Although FIG. 18 illustrates an aspect in which the system controller 100 includes the memories, such as the ROM 100B and the RAM 100C, for example, the memories, such as the ROM 100B and the RAM 100C, may be provided outside the system controller 100.

The communication unit 102 includes a communication interface to perform transmission and reception of data between the communication unit 102 and a host computer 103 connected to the communication interface.

The image memory 104 serves as a temporarily storage unit for various data items including image data, and allows read and write of data to be performed through the system controller 100. The image data taken from the host computer 103 through the communication unit 102 is temporarily stored in the image memory 104.

The transportation control unit 110 controls operation of a transportation system 11 of the cut-sheet paper S in the ink jet recorder 10. The transportation system 11 includes the treatment liquid barrel 42, the treatment liquid drying processing barrel 46, the drawing barrel 52, and the chain gripper 64, illustrated in FIG. 17.

The paper feeding control unit 112 illustrated in FIG. 18 allows the paper feeding unit 12 to operate in response to a command from the system controller 100 to control a supply start operation of the cut-sheet paper S and a supply stop operation thereof, and the like.

The treatment liquid applying control unit 114 allows the treatment liquid applying unit 14 to operate in response to a command from the system controller 100 to control an amount of application of the treatment liquid, timing of the application, and the like.

The treatment liquid drying control unit 116 allows the treatment liquid drying processing unit 16 to operate in response to a command from the system controller 100 to control drying temperature, a flow rate of dry gas, injection timing of the dry gas, and the like.

The drawing control unit 118 controls operation of a recording head provided in the drawing unit 18 in response to a command from the system controller 100. Each component constituting the drawing control unit 118 described below is not illustrated. In addition, in FIG. 18, the recording heads 56C, 56M, 56Y, and 56K, are not illustrated.

The drawing control unit 118 includes an image processing section that forms dot data from input image data, a waveform creating section that creates a waveform of driving voltage, a waveform storage section that stores the waveform of driving voltage, and a driving circuit that supplies driving voltage having a drive waveform corresponding to the dot data to the recording head.

The image processing section performs the following: color separation processing of separating input image data into each color of RGB; color conversion processing of converting RGB into CMYK; correction processing, such as gamma correction and unevenness correction; and halftone processing of converting a gradation value for each pixel of each color into gradation value less than an original gradation value.

The input image data includes raster data indicated by digital values from 0 to 255, for example. The dot data acquired as a result of the halftone processing may be a binary image, or a multiple value image of a ternary value or more.

Discharge timing and an amount of discharge of ink, at each pixel position, are determined in accordance with the dot data created through the processing by the image processing section. Then, driving voltage in accordance with the discharge timing and the amount of discharge of ink, at each pixel position, and a control signal of determining discharge timing of the each pixel, are created. The driving voltage is supplied to the recording head so that ink droplets are discharged from the recording head to form dots at a recording position.

The drawing control unit 118 may serve as the test image forming system 300 illustrated in FIG. 6.

The ink drying control unit 120 allows the ink drying processing unit 20 to operate in response to a command from the system controller 100 to control drying temperature, a flow rate of dry gas, injection timing of the dry gas, and the like.

The paper ejection control unit 124 allows the paper ejection unit 24 to operate in response to a command from the system controller 100 to load the cut-sheet paper S on the ejected paper base 76 illustrated in FIG. 17.

The in-line sensor 58 reads out an image drawn on the cut-sheet paper S so that the image is transmitted to the abnormal recording element detector 138 through the system controller 100. The abnormal recording element detector 138 analyzes presence or absence of an abnormal recording element in the recording head in accordance with a reading signal of the in-line sensor 58.

The image read out by the in-line sensor 58 includes a test image. It is also possible to read out a practical image.

The operation unit 130 illustrated in FIG. 18 includes an operation member, such as an operation button, a keyboard, and a touch panel, and transmits operation information inputted from the operation member to the system controller 100. The system controller 100 performs various kinds of processing in accordance with the operation information transmitted from the operation unit 130.

The display 132 includes a display device, such as a liquid crystal panel, and allows the display device to display information on the recorder, such as various setting information and abnormality information, in response to a command from the system controller 100.

As illustrated in FIG. 18, an output signal from the in-line sensor 58 is transmitted to the system controller 100. The system controller 100 allows the output signal from the in-line sensor 58 to be stored in a predetermined memory as reading information on an image.

A parameter storage unit 134 stores various parameters to be used in the ink jet recorder 10. The various parameters stored in the parameter storage unit 134 are read out through the system controller 100 to be set in each unit of the recorder.

A program storage unit 136 stores programs to be used in each unit of the ink jet recorder 10. The various programs stored in the program storage unit 136 are read out through the system controller 100 to be executed in the each unit of the recorder.

The abnormal recording element detector 138 corresponds to the control unit 402, the test image acquiring unit 404, the reading data processing unit 406, the white streak detection processing unit 408, the stage identifying processing unit 410, the abnormal recording element position identifying unit 412, the abnormal recording element position storage unit 414, and the buffer unit 416, illustrated in FIG. 9.

The system controller 100 illustrated in FIG. 18 may have a part of or all of the functions of the control unit 402 illustrated in FIG. 9. In addition, the RAM 100C may include the buffer unit 416 illustrated in FIG. 9.

Storing the test image forming program and the abnormal recording element detection program, described before, in the program storage unit 136 illustrated in FIG. 18, enables the test image forming program and the abnormal recording element detection program to be appropriately executed during performing image recording or during an idle period of the image recording.

(Structure of Recording Head)

FIG. 19 is a structural view of the recording head 56C, 56M, 56Y, and 56K, illustrated in FIG. 17, and is a perspective plan view of a discharge face of discharging droplets of ink. The same structure is applied to the recording heads 56C, 56M, 56Y, and 56K, corresponding to colors C, M, Y, and K, respectively. If it is unnecessary to distinguish the recording heads 56C, 56M, 56Y, and 56K, the recording heads 56C, 56M, 56Y, and 56K, may be described as the recording head 56 by omitting the alphabets.

The recording head 56 illustrated in FIG. 19 has a structure in which a plurality of head modules 200 is joined to each other in the first direction X that is a width direction of the cut-sheet paper S, and is orthogonal to the second direction Y that is a transportation direction of the cut-sheet paper S. The transportation direction of the cut-sheet paper S is synonymous with a transportation direction of a medium.

The same structure is applicable to each of the plurality of head modules 200 constituting the recording head 56. In addition, the head module 200 is allowed to serve as a single recording head.

Figure 22:
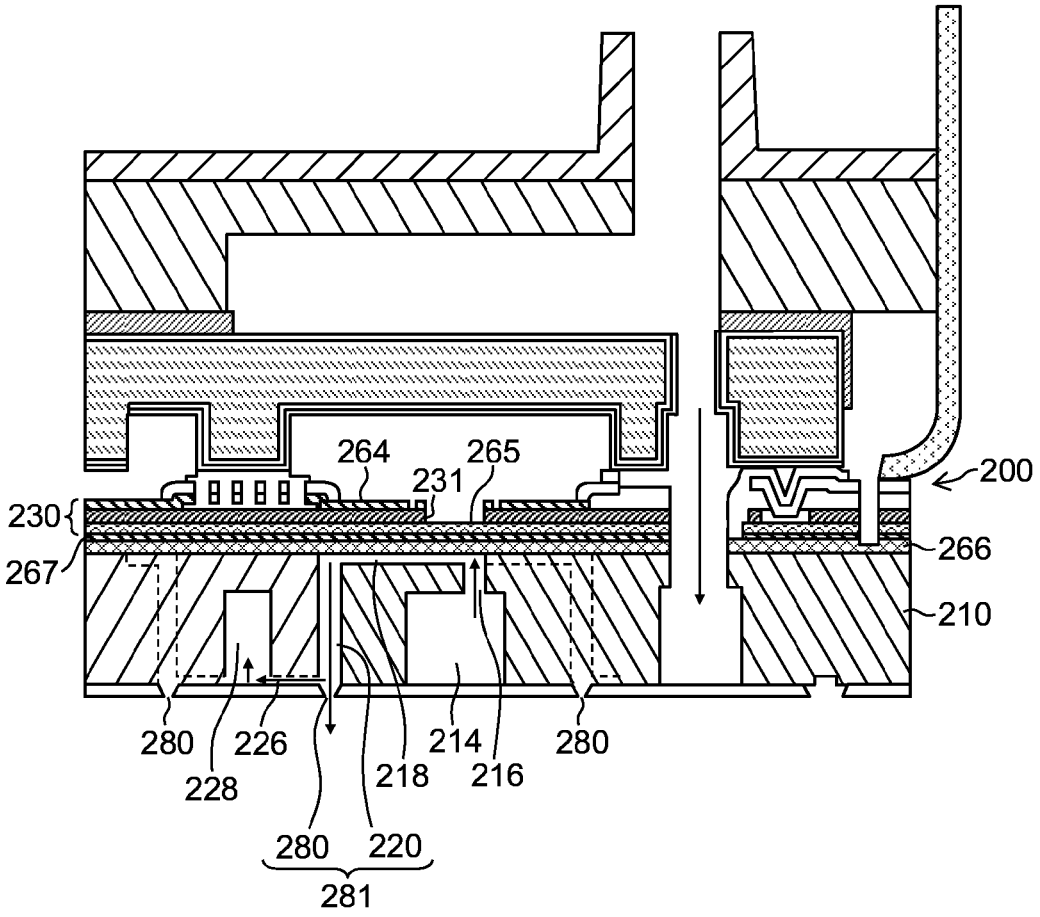
FIG. 22 is a sectional view illustrating an internal structure of the head module.

The recording head 56 illustrated in FIG. 19 is a full-line type recording head that has a structure in which the plurality of head modules 200 is arranged in a line along the first direction X, or a plurality of nozzle portions is arranged throughout a length in the first direction X corresponding to the full width $L_{max}$ of the cut-sheet paper S. In FIG. 19, the nozzle portions are not illustrated. The nozzle portions designated by a reference numeral 281 are illustrated in FIG. 22.

Figure 21:
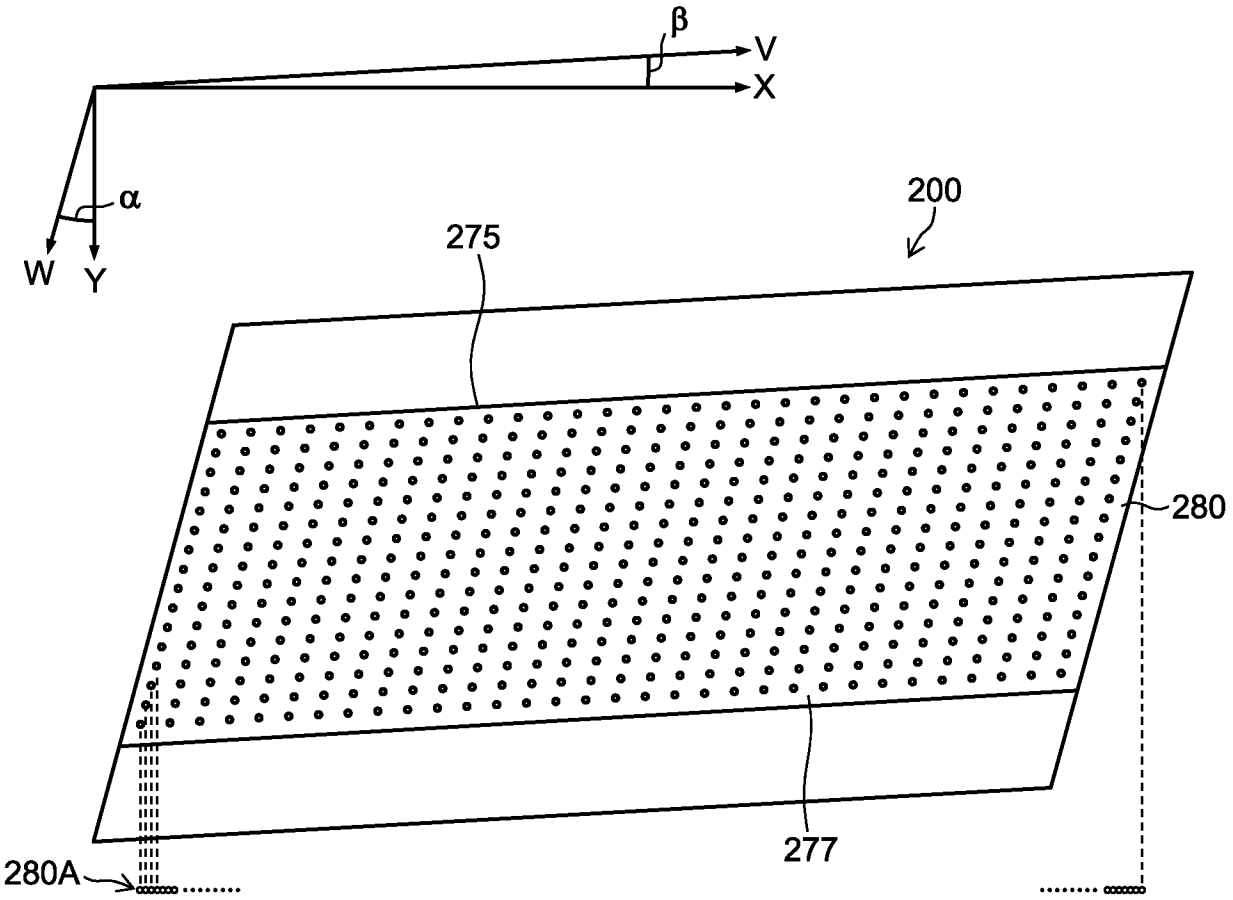
FIG. 21 is a perspective plan view of a discharge face in the head module illustrated in FIG. 20.

A plurality of nozzle apertures is arranged in a discharge face 277 of each of the head modules 200 constituting the recording head 56. In FIG. 19, the nozzle apertures are not illustrated. The nozzle apertures designated by a reference numeral 280 are illustrated in FIG. 21. Arrangement of the plurality of nozzle portions and the plurality of nozzle apertures will be described in detail.

Although the present example shows the recording head 56 that has a structure in which the plurality of head modules 200 is arranged in a line along the first direction X, for example, the plurality of head modules 200 may be arranged in a staggered fashion in the first direction X, or may be formed into an integral structure.

(Example of Structure of Recording Head)

Figure 20:
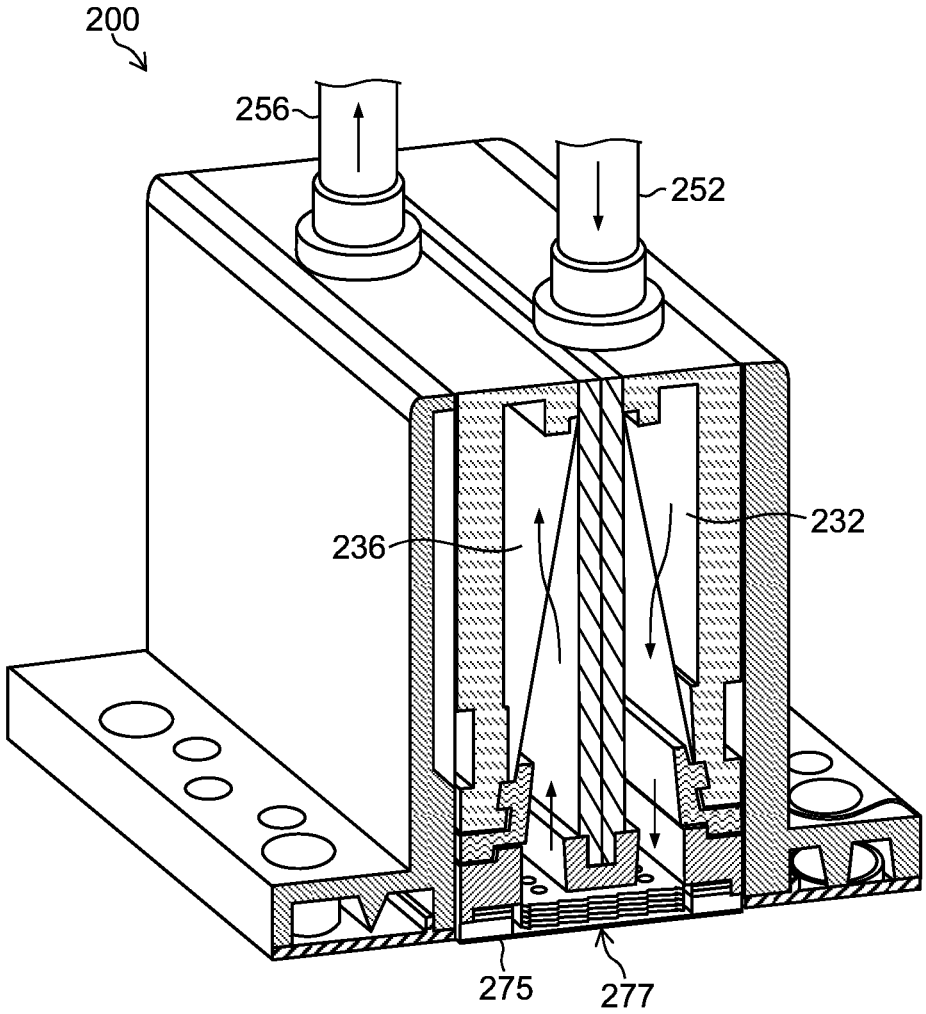
FIG. 20 is a perspective view of a head module, including a partly-sectioned view.

FIG. 20 is a perspective view of the head module 200, including a partly-sectioned view. FIG. 21 is a perspective plan view of the discharge face 277 in the head module 200 illustrated in FIG. 20.

As illustrated in FIG. 20, the head module 200 includes an ink supply unit composed of an ink supply chamber 232, an ink circulation chamber 236, and the like, on an upper side in FIG. 20 that is opposite to the discharge face 277 of a nozzle plate 275.

The ink supply chamber 232 is connected to an ink tank (not illustrated) through a supply conduit line 252, and the ink circulation chamber 236 is connected to a recovery tank (not illustrated) through a circulation conduit line 256.

While some nozzle apertures 280 are omitted, FIG. 21 illustrates the discharge face 277 of the nozzle plate 275 of one head module 200, in which the plurality of nozzle apertures 280 is arranged by two-dimensional arrangement.

That is, the head module 200 is formed in a plane shape of a parallelogram including an edge face on a long side along a V direction inclined by an angle β with respect to the first direction X, and an edge face on a short side along a W direction inclined by an angle α with respect to the second direction Y, and in the head module 200, the plurality of nozzle apertures 280 is arranged in a row direction along the V direction and in a column direction along the W direction to form a matrix arrangement.

Arrangement of the nozzle apertures 280 is not limited to the form illustrated in FIG. 21, and the plurality of nozzle apertures 280 may be arranged along a row direction along the first direction X, and a column direction intersecting the first direction X at an angle.

That is, the matrix arrangement of the nozzle apertures 280 allows intervals between the nozzle apertures 280, or between the nozzles, to be uniform in a projection nozzle group in the first direction X including a plurality of nozzle apertures 280 that is arranged along the first direction X by being projected in the first direction X.

The projection nozzle group in the first direction X includes a joint portion between the head modules 200 adjacent to each other where the nozzle apertures 280 belonging to one of the head modules 200 and belonging to the other thereof are mixed.

If there is no error in an attachment position of each of the head modules 200, the nozzle apertures 280 belonging to one of the head modules 200 and belonging to the other thereof are arranged at the same position in a joint area. As a result, arrangement of the nozzle apertures 280 is uniform even in the joint area.

FIG. 22 is a sectional view illustrating an internal structure of the head module 200. Reference numerals 214 and 218 designate an ink supply channel and pressure chambers, respectively, and reference numerals 216 and 220 designate an individual supply channel connecting each of the pressure chambers 218 and the ink supply channel 214, and a nozzle communication passage connecting to the nozzle aperture 280 from the pressure chamber 218, respectively, and also a reference numeral 226 designates a circulation individual flow channel connecting the nozzle communication passage 220 and a circulation common flow channel 228. The pressure chamber 218 is sometimes called a liquid chamber.

A vibrating plate 266 is provided on a flow channel structure 210 including the flow channels 214, 216, 218, 220, 226, and 228. A piezoelectric element 230 composed of a laminated structure with a lower electrode 265, a piezoelectric body layer 231, and an upper electrode 264, is provided on the vibrating plate 266 through an adhesive layer 267. The lower electrode 265 and the upper electrode 264 are sometimes called a common electrode and an individual electrode, respectively.

The upper electrode 264 is an individual electrode that is patterned in accordance with a shape of each of the pressure chambers 218, and the piezoelectric element 230 is provided for each of the pressure chambers 218.

The ink supply channel 214 communicates with the ink supply chamber 232 described in FIG. 20 to allow ink to be supplied to the pressure chamber 218 through from the ink supply channel 214 to the individual supply channel 216. Applying driving voltage to the upper electrode 264 of the piezoelectric element 230 provided in the corresponding pressure chamber 218 in accordance with image data on an image to be recorded allows the piezoelectric element 230 and the vibrating plate 266 to be deformed to change volume of the pressure chamber 218. Accordingly, pressure in the pressure chamber 218 is changed to allow ink to be discharged from the nozzle aperture 280 through the nozzle communication passage 220.

Controlling drive of the piezoelectric element 230 corresponding to each of the nozzle apertures 280 in accordance with dot arrangement data created from the image data enables ink droplets to be discharged from each of the nozzle apertures 280.

While the cut-sheet paper S is transported in the second direction Y at a predetermined speed, controlling timing of discharging ink from each of the nozzle apertures 280 in accordance with the transportation speed enables a desired image to be formed on the cut-sheet paper S.

While no illustration is illustrated, the pressure chamber 218 provided corresponding to each of the nozzle apertures 280 is formed in a substantially square shape in plan view, in which an outflow port to the nozzle aperture 280 is provided at one of opposite corners in a diagonal line and the individual supply channel 216 that is an inflow port of supplying ink is provided at the other thereof.

The shape of the pressure chamber is not limited to a square. The pressure chamber may be formed in various shapes in plan view, such as a lozenge, a quadrangle such as a rectangle, a pentagon, a hexagon, other polygons, a circle, and an ellipse.

The nozzle portion 281 including the nozzle aperture 280 and the nozzle communication passage 220 is provided with a circulation outlet (not illustrated), and the nozzle portion 281 communicates with the circulation individual flow channel 226 through the circulation outlet.

Ink in the nozzle portion 281, which is not used for discharge, is retrieved to the circulation common flow channel 228 through the circulation individual flow channel 226.

The circulation common flow channel 228 communicates with the ink circulation chamber 236 described in FIG. 20, so that ink is always retrieved to the circulation common flow channel 228 through the circulation individual flow channel 226 to prevent viscosity of the ink in the nozzle portion at the time of non-discharge from increasing.

An applicable range of the present invention is not limited to the structures illustrated in FIGS. 19 to 22. The nozzle aperture 280 and the nozzle portion 281 may be arranged in a line in the first direction X that is the width direction of the cut-sheet paper S, or may be arranged in two lines in a staggered fashion.

FIG. 22 illustrates the piezoelectric element 230 that has a structure in which the piezoelectric element is individually divided corresponding to each of the nozzle portions 281, as an example of the piezoelectric element. As a matter of course, it is allowed to use a structure in which the piezoelectric body layer 231 is integrally formed for the plurality of nozzle portions 281, and an individual electrode is formed corresponding to each of the nozzle portions 281 to form an active area for each of the nozzle portions 281.

It is also allowed to use a thermal method in which a heater is provided inside the pressure chamber 218 as a pressure generating element instead of the piezoelectric element, and driving voltage is supplied to the heater so that the heater generates heat to allow ink in the pressure chamber 218 to be discharged from the nozzle aperture 280 by using a film boiling phenomenon.

It is possible to apply modification, addition, elimination, and the like to the configuration of the image recorder of an ink-jet method described with reference to FIGS. 17 to 22. For example, it is possible to eliminate a configuration related to application of a treatment liquid, and drying of the treatment liquid, as well as possible to change a configuration of a transportation system of a recording medium.

The test image, the test image forming system, the test image forming method, the test image forming program, the storage medium, the abnormal recording element detection system, the abnormal recording element detection method, the abnormal recording element detection program, and the storage medium, described above, can be appropriately modified, added, and eliminated within a range without departing from the spirit of the present invention. In addition, each of the embodiments described above can also be appropriately combined.

What is claimed is:

1. An abnormal recording element detection system comprising:

a processor serving as:

a test image acquiring unit that acquires a test image created in accordance with input data or reading data on the test image, the input data allowing the test image to be formed on a recording medium by allowing a recording head and the recording medium to relatively move in a first direction and a second direction orthogonal to the first direction, in which input data, N representing an integer of 1 or more, a plurality of recording elements selected every N pieces in a projected recording element group of a plurality of recording elements provided in the recording head, is indicated as a first recording element projected in the first direction, and a recording element that is not selected as the first recording element is indicated as a second recording element, the input data allowing: a first-stage pattern with a predetermined length to be formed in a recording area of the second recording element in accordance with a second input gradation value in the second direction; a recording position in the second direction to be sequentially changed; and the first recording element and the second recording element to be sequentially switched to form a second-stage pattern to an (N+1)-th-stage pattern; and an analysis unit that analyzes the test image acquired to detect an abnormal recording element in the recording head, wherein the analysis unit extracts a low density position with density less than a second density value corresponding to the second input gradation value from a recording area of the second recording element in the test image to identify a plurality of recording elements expected to include an abnormal recording element in accordance with the low density position extracted, wherein the analysis unit identifies a stage with no abnormal recording as well as identifies a recording element corresponding to a stage identified from among a plurality of recording elements expected to include an abnormal recording element as an abnormal recording element.

2. The abnormal recording element detection system according to claim 1, wherein the analysis unit identifies a stage with a uniform interval of the low density position as a stage with no abnormality.

3. The abnormal recording element detection system according to claim 1, wherein the analysis unit creates a detection profile showing a relationship between a reading position and a reading signal value for each of stages constituting the test image in accordance with the acquired reading data on the test image to identify a stage whose detection profile has no difference from a reference profile, which is previously acquired as a base, as a stage with no abnormality in a detection profile.

4. The abnormal recording element detection system according to claim 3, wherein the reference profile is created from reading data on a test image recorded by using a recording head with no abnormal recording element.

5. An abnormal recording element detection system comprising:

a processor serving as:

a test image acquiring unit that acquires a test image created in accordance with input data or reading data on the test image, the input data allowing the test image to be formed on a recording medium by allowing a recording head and the recording medium to relatively move in a first direction and a second direction orthogonal to the first direction, in which input data, N representing an integer of 1 or more, a plurality of recording elements selected every N pieces in a projected recording element group of a plurality of recording elements provided in the recording head, is indicated as a first recording element projected in the first direction, and a recording element that is not selected as the first recording element is indicated as a second recording element, the input data allowing: a first-stage pattern with a predetermined length to be formed in a recording area of the second recording element in accordance with a second input gradation value in the second direction; a recording position in the second direction to be sequentially changed; and the first recording element and the second recording element to be sequentially switched to form a second-stage pattern to an (N+1)-th-stage pattern; and an analysis unit that analyzes the test image acquired to detect an abnormal recording element in the recording head, wherein the analysis unit extracts a high density position with density more than a second density value corresponding to the second input gradation value from a recording area of the second recording element in the test image to detect a plurality of recording elements expected to include an abnormal recording element in accordance with the high density position extracted, wherein the analysis unit identifies a stage with no abnormal recording as well as identifies a recording element corresponding to a stage identified from among a plurality of recording elements expected to include an abnormal recording element as an abnormal recording element.

6. The abnormal recording element detection system according to claim 5, wherein the analysis unit identifies a stage with a lack of a high density position as well as with a uniform interval of the low density position with density less than the second density value corresponding to the second input gradation value, as a stage with no abnormality.

7. The abnormal recording element detection system according to claim 5, wherein the analysis unit identifies a stage with a uniform interval of the low density position as a stage with no abnormality.

8. The abnormal recording element detection system according to claim 5, wherein the analysis unit creates a detection profile showing a relationship between a reading position and a reading signal value for each of stages constituting the test image in accordance with the acquired reading data on the test image to identify a stage whose detection profile has no difference from a reference profile, which is previously acquired as a base, as a stage with no abnormality in a detection profile.

9. An abnormal recording element detection system comprising:

a processor serving as:

a test image acquiring unit that acquires a test image created in accordance with input data or reading data on the test image, the input data allowing the test image to be formed on a recording medium by allowing a recording head and the recording medium to relatively move in a first direction and a second direction orthogonal to the first direction, in which input data, N representing an integer of 1 or more, a plurality of recording elements selected every N pieces in a projected recording element group of a plurality of recording elements provided in the recording head, is indicated as a first recording element projected in the first direction, and a recording element that is not selected as the first recording element is indicated as a second recording element, the input data allowing: a first-stage pattern with a predetermined length to be formed in a recording area of the second recording element in accordance with a second input gradation value in the second direction; a recording position in the second direction to be sequentially changed; and the first recording element and the second recording element to be sequentially switched to form a second-stage pattern to an (N+1)-th-stage pattern; and an analysis unit that analyzes the test image acquired to detect an abnormal recording element in the recording head, wherein the test image acquiring unit acquires a test image including a uniform density portion with a third density value corresponding to a third input gradation value in a recording area of the first recording element and a recording area of the second recording element, and wherein the analysis unit identifies a plurality of recording elements expected to include an abnormal recording element in accordance with an analysis result of the uniform density portion, wherein the analysis unit identifies a stage with no abnormal recording as well as identifies a recording element corresponding to a stage identified from among a plurality of recording elements expected to include an abnormal recording element as an abnormal recording element.

10. The abnormal recording element detection system according to claim 9, wherein the analysis unit identifies a stage with a uniform interval of the low density position as a stage with no abnormality.

11. The abnormal recording element detection system according to claim 9, wherein the analysis unit creates a detection profile showing a relationship between a reading position and a reading signal value for each of stages constituting the test image in accordance with the acquired reading data on the test image to identify a stage whose detection profile has no difference from a reference profile, which is previously acquired as a base, as a stage with no abnormality in a detection profile.

12. An abnormal recording element detection system comprising:

a processor serving as:

a test image acquiring unit that acquires a test image created in accordance with input data or reading data on the test image, the input data allowing the test image to be formed on a recording medium by allowing a recording head and the recording medium to relatively move in a first direction and a second direction orthogonal to the first direction, in which input data, N representing an integer of 1 or more, a plurality of recording elements selected every N pieces in a projected recording element group of a plurality of recording elements provided in the recording head, is indicated as a first recording element projected in the first direction, and a recording element that is not selected as the first recording element is indicated as a second recording element, the input data allowing: a first-stage pattern with a predetermined length to be formed in a recording area of the second recording element in accordance with a second input gradation value in the second direction; a recording position in the second direction to be sequentially changed; and the first recording element and the second recording element to be sequentially switched to form a second-stage pattern to an (N+1)-th-stage pattern; and an analysis unit that analyzes the test image acquired to detect an abnormal recording element in the recording head, wherein the test image acquiring unit acquires a practical image, and wherein the analysis unit identifies a plurality of recording elements expected to include an abnormal recording element in accordance with the acquired practical image, wherein the analysis unit identifies a stage with no abnormal recording as well as identifies a recording element corresponding to a stage identified from among a plurality of recording elements expected to include an abnormal recording element as an abnormal recording element.

13. The abnormal recording element detection system according to claim 12, wherein the analysis unit identifies a stage with a uniform interval of the low density position as a stage with no abnormality.

14. The abnormal recording element detection system according to claim 12, wherein the analysis unit creates a detection profile showing a relationship between a reading position and a reading signal value for each of stages constituting the test image in accordance with the acquired reading data on the test image to identify a stage whose detection profile has no difference from a reference profile, which is previously acquired as a base, as a stage with no abnormality in a detection profile.

* * * * *